US010301888B2

(12) United States Patent
Richards et al.

(10) Patent No.: US 10,301,888 B2
(45) Date of Patent: May 28, 2019

(54) TRAVEL JOINT RELEASE DEVICES AND METHODS

(71) Applicant: HALLIBURTON ENERGY SERVICES, INC., Houston, TX (US)

(72) Inventors: William Mark Richards, Flower Mound, TX (US); Timothy Edward Harms, The Colony, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 516 days.

(21) Appl. No.: 14/787,943

(22) PCT Filed: May 31, 2013

(86) PCT No.: PCT/US2013/043765

§ 371 (c)(1),
(2) Date: Oct. 29, 2015

(87) PCT Pub. No.: WO2014/193420

PCT Pub. Date: Dec. 4, 2014

(65) Prior Publication Data

US 2016/0123093 A1 May 5, 2016

(51) Int. Cl.
*E21B 17/06* (2006.01)
*E21B 17/07* (2006.01)

(52) U.S. Cl.
CPC ..... *E21B 17/07* (2013.01); *E21B 17/06* (2013.01)

(58) Field of Classification Search
CPC ..... E21B 17/06; E21B 17/07
See application file for complete search history.

(56) References Cited

U.S. PATENT DOCUMENTS

| | | | | |
|---|---|---|---|---|
| 4,433,725 | A | 2/1984 | Bowyer | |
| 4,805,696 | A | 2/1989 | Henderson | |
| 5,181,569 | A | 6/1993 | McCoy et al. | |
| 5,718,291 | A * | 2/1998 | Lorgen | E21B 17/06 166/377 |
| 6,367,552 | B1 * | 4/2002 | Scott | E21B 17/07 166/242.7 |

(Continued)

OTHER PUBLICATIONS

International Search Report and Written Opinion issued in related PCT Application No. PCT/US2013/043765 dated Feb. 19, 2014, 11 pages.

*Primary Examiner* — Matthew R Buck
(74) *Attorney, Agent, or Firm* — Benjamin Fite; Baker Botts L.L.P.

(57) ABSTRACT

A travel joint comprises an outer housing, an inner mandrel, a first release device positioned between the outer housing and the inner mandrel, and a second release device positioned between the outer housing and the inner mandrel. The first release device is configured to actuate from the locked position to the unlocked position in response to a fluid pressure supplied to the first release device. The second release device is configured to selectively prevent and allow relative axial movement between the outer housing and the inner mandrel in response to an axial force applied to at least one of the outer housing or the inner mandrel, and the first release device is configured to prevent the application of the axial force to actuate the second release device in the locked position and allow the axial force to actuate the second release device in the unlocked position.

21 Claims, 12 Drawing Sheets

(56) References Cited

U.S. PATENT DOCUMENTS

| | | | | |
|---|---|---|---|---|
| 6,540,025 | B2 * | 4/2003 | Scott | E21B 17/07 166/338 |
| 7,730,957 | B2 | 6/2010 | Blanton et al. | |
| 8,499,826 | B2 * | 8/2013 | Hillis | E21B 47/18 166/319 |
| 8,770,278 | B2 * | 7/2014 | Lauderdale | E21B 23/02 166/123 |
| 2006/0131011 | A1 * | 6/2006 | Lynde | E21B 17/06 166/123 |
| 2012/0205117 | A1 | 8/2012 | Harms | |
| 2013/0025880 | A1 * | 1/2013 | Richards | E21B 17/07 166/380 |

* cited by examiner

TRAVEL JOINT RELEASE DEVICES AND METHODS

CROSS-REFERENCE TO RELATED APPLICATION

The present application is a U.S. National Stage Application of International Application No. PCT/US2013/043765 filed May 31, 2013, which is incorporated herein by reference in its entirety for all purposes.

BACKGROUND

Drilling rigs supported by floating drill ships or floating platforms are often used for offshore well development. These rigs present a problem for the rig operators in that ocean waves and tidal forces cause the drilling rig to rise and fall with respect to the sea floor and the subterranean well. This vertical motion must be either controlled or compensated while operating the well. Without compensation, such vertical movement may transmit undesirable axial loads on the rigid tubular strings that extended downwardly from the drilling rig. This problem becomes particularly acute in well operations involving fixed bottom hole assemblies, such as packers.

For example, once a lower completion has been installed in a casing string or open hole location, it is common to stab the lower end of the upper completion, run into the well on a tubing string, into the packer at the top of the lower completion assembly. Typically, the connection operation requires that the tubing string apply a predetermined amount of axial and/or rotational force against the packer. Once connected, any vertical movement from the ship or platform will create undesirable downward and upward forces on the packer or may cause premature actuation and/or failure of components.

During the installation process, a travel joint in the tubing string may be used to allow for telescopic extension and contraction of the tubing string. Typically, the travel joint is run downhole in a locked position, then unlocked once the tubing string is connected to the packer. Various forces may result in the unlocking of the travel joint during conveyance and installation, which is to say before the travel joint is coupled to the packer. Once unlocked, it is virtually impossible to sting into the packer without relocking the travel joint, which may require an additional trip out of the well to redress the travel joint.

SUMMARY

In an embodiment, a travel joint comprises an outer housing, an inner mandrel slidingly disposed within the outer housing, and a release device positioned between the outer housing and the inner mandrel. The release device comprises: a plurality of lugs, and the plurality of lugs is configured to prevent relative axial movement between the outer housing and the inner mandrel in a locked position and allow relative axial movement between the outer housing and the inner mandrel in an unlocked position. The release device is configured to selectively prevent and allow relative axial movement between the outer housing and the inner mandrel in response to a fluid pressure supplied to the release device from a flowbore of the outer housing or a flowbore of the inner mandrel.

In an embodiment, a travel joint comprises an outer housing, an inner mandrel slidingly disposed within the outer housing, and a release device positioned between the outer housing and the inner mandrel. The release device comprises: an outwardly biased locking ring, where the locking ring is configured to radially compress and engage the inner mandrel in a locked position and radially expand and disengage from the inner mandrel in an unlocked position. The release device is configured to selectively prevent and allow relative axial movement between the outer housing and the inner mandrel in response to a fluid pressure supplied to the release device from a flowbore of the outer housing or a flowbore of the inner mandrel.

In an embodiment, a method of releasing a travel joint comprises preventing relative axial movement between an outer housing and an inner mandrel in a travel joint, providing a fluid pressure to a flowbore of the outer housing or a flowbore of the inner mandrel of the release device in a locked position, actuating the release device from the locked position to an unlocked position based on the fluid pressure, and allowing relative movement between the outer housing and the inner mandrel when the release device is in the unlocked position. The release device is disposed between the outer housing and the inner mandrel in a travel joint.

In an embodiment, a travel joint comprises an outer housing, an inner mandrel slidingly disposed within the outer housing, and a release device positioned between the outer housing and the inner mandrel. The release device comprises: a plurality of lugs, where the plurality of lugs is configured to prevent relative axial movement between the outer housing and the inner mandrel in a locked position and allow relative axial movement between the outer housing and the inner mandrel in an unlocked position. The release device is configured to selectively prevent and allow relative axial movement between the outer housing and the inner mandrel in response to a fluid pressure supplied to the release device from a control line.

In an embodiment, a travel joint comprises an outer housing, an inner mandrel slidingly disposed within the outer housing, and a release device positioned between the outer housing and the inner mandrel. The release device comprises an outwardly biased locking ring, where the locking ring is configured to radially compress and engage the inner mandrel in a locked position and radially expand and disengage from the inner mandrel in an unlocked position. The release device is configured to selectively prevent and allow relative axial movement between the outer housing and the inner mandrel in response to a fluid pressure supplied to the release device from a surface of a wellbore.

In an embodiment, a method of releasing a travel joint comprises preventing relative axial movement between an outer housing and an inner mandrel in a travel joint, providing a fluid pressure through a control line when the release device in a locked position, actuating the release device from the locked position to an unlocked position based on the fluid pressure, and allowing relative movement between the outer housing and the inner mandrel when the release device is in the unlocked position. The release device is disposed between the outer housing and the inner mandrel in a travel joint.

In an embodiment, a travel joint comprises an outer housing, an inner mandrel slidingly disposed within the outer housing, and a release device positioned between the outer housing and the inner mandrel. The release device comprises: a locking ring engaged with the outer housing and the inner mandrel, and a locking sleeve configured to radially align with the locking ring in a locked position and axially translate out of radial alignment with the locking ring in the unlocked position. The release device is configured to selectively prevent and allow relative axial movement between the outer housing and the inner mandrel in response to a fluid pressure supplied to the release device from an exterior of the outer housing.

In an embodiment, a travel joint comprises an outer housing, an inner mandrel slidingly disposed within the outer housing, and a release device positioned between the outer housing and the inner mandrel. The release device is in fluid communication with an exterior of the outer housing, and the release device is configured to selectively prevent and allow relative axial movement between the outer housing and the inner mandrel in response to a fluid pressure supplied from an exterior of the outer housing.

In an embodiment, a method of releasing a travel joint comprises preventing relative axial movement between an outer housing and an inner mandrel in a travel joint, providing a fluid pressure from an exterior of the outer housing to a release device in a locked position, actuating the release device from the locked position to an unlocked position based on the fluid pressure, and allowing relative movement between the outer housing and the inner mandrel when the release device is in the unlocked position. The release device is disposed between the outer housing and the inner mandrel in a travel joint.

In an embodiment, a travel joint comprises an outer housing, an inner mandrel slidingly disposed within the outer housing, a first release device positioned between the outer housing and the inner mandrel, and a second release device positioned between the outer housing and the inner mandrel. The first release device is configured to prevent relative axial movement between the outer housing and the inner mandrel in a locked position and allow relative axial movement between the outer housing and the inner mandrel in an unlocked position. The first release device is configured to actuate from the locked position to the unlocked position in response to a fluid pressure supplied to the first release device, and the second release device is configured to selectively prevent and allow relative axial movement between the outer housing and the inner mandrel in response to an axial force applied to at least one of the outer housing or the inner mandrel. The first release device is configured to prevent the application of the axial force to actuate the second release device in the locked position and allow the axial force to actuate the second release device in the unlocked position.

In an embodiment, a travel joint comprises an outer housing, an inner mandrel slidingly disposed within the outer housing, and a plurality of release devices. At least two of the plurality of release devices is configured to actuate in response to different forces, and the different forces comprise at least a mechanical force and a pressure force. The plurality of release devices are configured to be sequentially actuated from a locked position to an unlocked position.

In an embodiment, a method of releasing a travel joint comprises preventing relative axial movement between an outer housing and an inner mandrel in a travel joint, providing a fluid pressure to a first release device in a locked position, actuating the first release device from the locked position to an unlocked position based on the fluid pressure, providing a mechanical force to a second release device in a locked position, actuating the second release device from the locked position to an unlocked position based on the mechanical force, and allowing relative movement between the outer housing and the inner mandrel when the first release device is in the unlocked position and when the second release device is in the unlocked position. The first release device is disposed between the outer housing and the inner mandrel in a travel joint.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
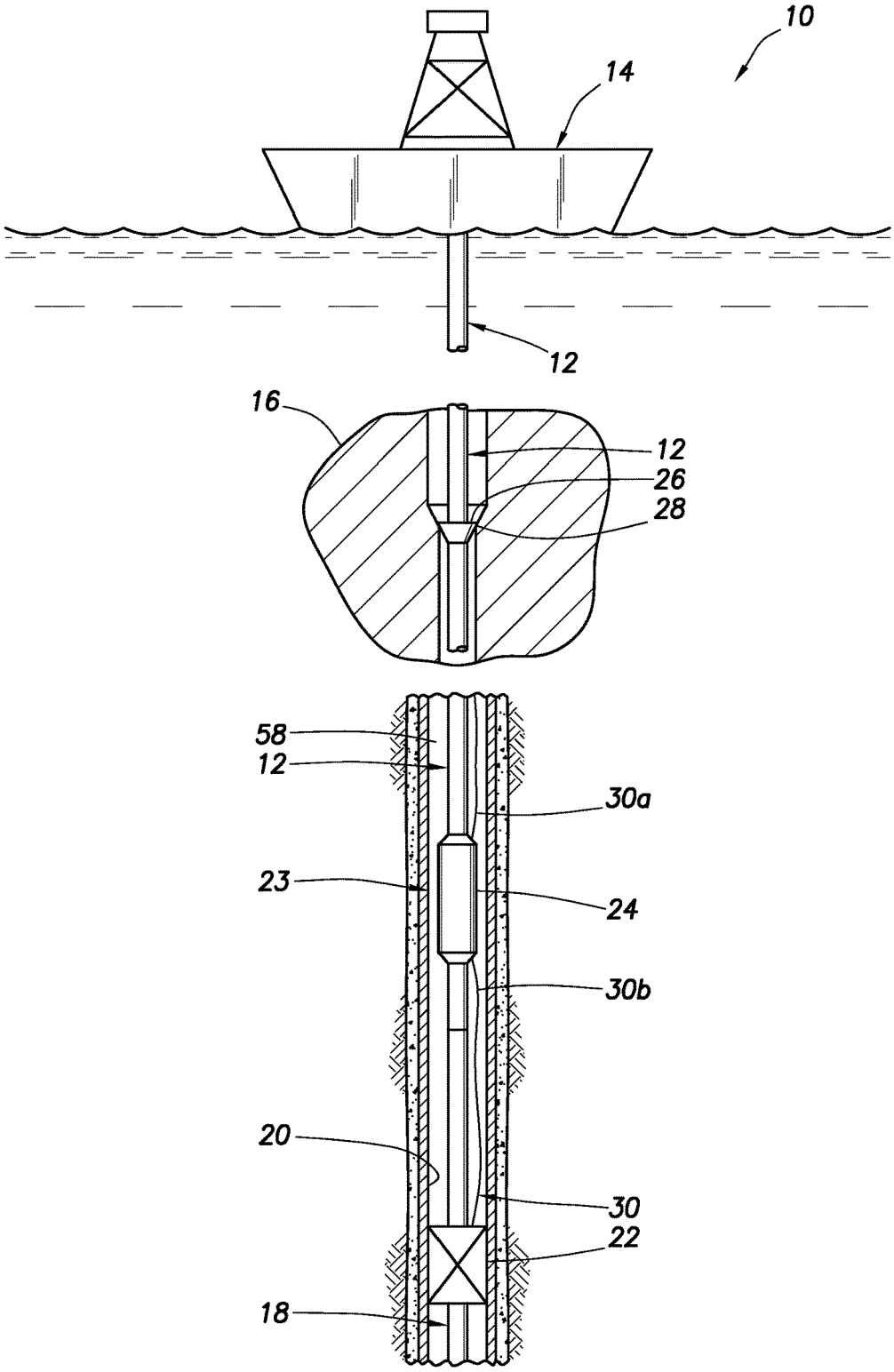
FIG. 1 is a schematic illustration of an embodiment of a wellbore operating environment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed infra may be employed separately or in any suitable combination to produce desired results.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," or "upward" meaning toward the surface of the wellbore and with "down," "lower," or "downward" meaning toward the terminal end of the well, regardless of the wellbore orientation. Reference to in or out will be made for purposes of description with "in," "inner," or "inward" meaning toward the center or central axis of the wellbore, and with "out," "outer," or "outward" meaning toward the wellbore tubular and/or wall of the wellbore. Reference to "longitudinal," "longitudinally," or "axially" means a direction substantially aligned with the main axis of the wellbore and/or wellbore tubular. Reference to "radial" or "radially" means a direction substantially aligned with a line between the main axis of the wellbore and/or wellbore tubular and the wellbore wall that is substantially normal to the main axis of the wellbore and/or wellbore tubular, though the radial direction does not have to pass through the central axis of the wellbore and/or wellbore tubular. The various characteristics mentioned above, as well as other features and characteristics described in more detail below, will be readily apparent to those skilled in the art with the aid of this disclosure upon reading the following detailed description of the embodiments, and by referring to the accompanying drawings.

Installing a wellbore tubular string (e.g., a completion string) within a wellbore may involve the application of various forces at various times. For example, stabbing seals into a packer requires some amount of force, and stabbing seals into multiple seal bores (e.g. multi-zone well) requires additional force as the stabbing forces are additive. Stabbing communication devices such as fiber optic wet mate connectors or electric wet mate connectors may require a sustained application of compression force. Further, the combination of establishing a communication connection while concurrently stabbing seals into one or more seal bores may require a relatively high sustained force. These forces may be the same as those used to release various components, such as actuating a travel joint to allow the travel joint to telescope to further a completion string installation within a wellbore. For example, a hydraulic release mechanism may rely upon the application of a vertical force for a predetermined period of time to allow a fluid to transfer from a first chamber to a second chamber. While the hydraulic release mechanism can be designed to actuate only upon the application of a force above a threshold, the forces associated with conveying the wellbore tubular string into position as well as installing various components within the wellbore may result in at least a partial activation of the hydraulic actuation mechanism. The actuation process may then be subject to some uncertainty as to the amount of time a force must be applied. In some instances, the release mechanism may be prematurely actuated so that the travel joint is unlocked prior to setting other components such as packers. In these instances, a resetting process may be required that can involve retrieving the wellbore tubular string to the surface to reset the release mechanism. Such operations are costly in terms of both time and expense.

As described herein, various release devices may be used with a travel joint that release upon the application of a specific pressure or force over a threshold. For example, a release device may comprise a piston coupled to a propping type sleeve. The sleeve may serve to maintain a locking ring, lug, or collet indicator in a position configured to maintain an engagement between the outer housing of the travel joint and the inner mandrel, thereby preventing the travel joint from telescoping. The application of a pressure to the piston may serve to displace the piston, thereby un-propping the locking ring, lug, or collet indicator and allowing the inner mandrel to move relative to the outer housing. The pressure applied to the piston may come from a tubing pressure, a control line pressure, or the like. In some embodiments disclosed herein, an external pressure such as an annular pressure within a wellbore may be used to actuate a piston and un-prop a locking ring, lug, or collet indicator or the like to unlock a release device in a travel joint. Still further, a release device may release in response to an axial force above a threshold. The threshold may be selected to ensure that the release device is not actuated during the normal axial forces used in the installation process. Some of the release devices described herein may be non-resettable while others may allow the travel joint to be re-locked after being actuated to an unlocked position.

The release devices described herein may be used alone or in combination with a hydraulically metered release device, wherein the pressure-based release device can be used to prevent the premature actuation of the hydraulic release device. The resulting two-step release process may improve the consistency of the unlocking process. The use of a pressure based or axial force based release mechanism may allow for the inclusion of multiple control lines to pass through the travel joint without a concern about rotational motion damaging one or more of the control lines. Further, the loads (e.g., compression and/or tensile loads) placed across the travel joint in the locked position may not be placed on the release mechanisms within the release device, which may help to prevent potential damage to the release mechanisms within the release device.

Representatively illustrated in FIG. 1 is a well system 10 and associated method that can embody principles of this disclosure. In the system 10, a wellbore tubular string 12 extends downward from an offshore rig 14 (such as a drill ship, floating platform, jack-up platform, etc.) into a wellbore 20. The wellbore tubular string 12 may be in a riser between the rig 14 and a wellhead 16, or a riser may not be used. The wellbore 20 may be drilled into the subterranean formation using any suitable drilling technique. The wellbore 20 is illustrated as extending substantially vertically away from the surface of the ocean floor over a vertical wellbore portion. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multilateral wellbore, and other types of wellbores for drilling and completing one or more production zones. Further, the wellbore may be used for both producing wells and injection wells. The wellbore may also be used for purposes other than hydrocarbon production such as water recovery (e.g., potable water recovery), geothermal recovery, and the like.

While the operating environment depicted in FIG. 1 refers to an offshore rig 14 for conveying the wellbore tubular string 12, in alternative embodiments, stationary rigs, land-based rigs, mobile workover rigs, wellbore servicing units (such as coiled tubing units), and the like may be used to convey the wellbore tubular string 12 within the wellbore 20. It should be understood that a wellbore tubular string 12 may alternatively be used in other operational environments, such as within a land-based wellbore operational environment.

The wellbore tubular string 12 is illustrated as being stabbed into a completion assembly 18 previously installed in a wellbore 20. In the embodiment depicted in FIG. 1, the wellbore tubular string 12 is sealingly received in a packer 22 at an upper end of the completion assembly 18. In some embodiments, the wellbore tubular string 12 can have a seal stack thereon which seals within a sealed bore receptacle (e.g., above a liner hanger, etc.). Any manner of connecting the wellbore tubular string 12 with the completion assembly 18 may be used in keeping with the scope of this disclosure.

The completion assembly 18 is preferably used to complete a portion of the well, that is, to prepare the well for production or injection operations. The completion assembly 18 could include elements which facilitate such production or injection (such as, packers, well screens, perforated liner or casing, production or injection valves, chokes, etc.).

A travel joint system 23 is used to provide for dimensional variations between the completion assembly 18 and the wellhead 16. After the wellbore tubular string 12 has been connected to the completion assembly 18, a travel joint 24 in the wellbore tubular string 12 is released to allow the wellbore tubular string 12 to be landed in the wellhead 16. As illustrated in FIG. 1, a hanger 26 can be landed on a wear bushing 28, or alternatively, other manners of securing a tubular string in a wellhead may be used in keeping with the scope of this disclosure.

The travel joint 24 permits some variation in the length of the wellbore tubular string 12 between the hanger 26 and the completion assembly 18. In some embodiments, the travel joint 24 can be used to allow the length of the tubular string 12 to shorten after the completion assembly 18 has been sealingly engaged, so that the hanger 26 can be appropriately landed in the wellhead 16.

The travel joint 24 in the system 10 may also comprise one or more control or fluid lines 30 that may be disposed in one or more sections 30*a*, 30*b*, at least some of which may pass through the travel joint 24. The lines 30 may be disposed in an annulus 58 formed radially between the wellbore tubular string 12 and the interior surface of the wellbore 20. The control lines may convey fluid, electrical conductors, fiber optics, or a hybrid combination of the three. The lines 30 may be used for any purpose (e.g., supplying pressure, supplying flow, supplying power, data transfer, communication, telemetry, chemical injection, etc.) in keeping with the scope of this disclosure. In general, the lines 30 can be coiled around the travel joint 24 so that the coil elongates or compresses along with the travel joint 24 once it is released. In some embodiments, alternative configurations may be used to couple the lines 30 along the length of the travel joint 24 due to considerations such as size of the lines 30, the number of lines, or the like. As described in more detail below, one or more of the lines may be used to provide a signal to release or unlock the travel joint 24.

A suitable travel joint is described in U.S. Pat. No. 6,540,025, the entire disclosure of which is incorporated herein by reference. The travel joint described in that patent includes a hydraulic release device which releases the travel joint in response to a predetermined compressive force being applied to the travel joint for a predetermined amount of time. The described travel joint also includes a resetting feature whereby the travel joint can be again locked in its extended configuration, after having been compressed. While the hydraulic release device is suitable in some circumstances, additional release devices may also be used in various circumstances. The additional devices, as described in more detail below, may be used alone or in addition to the hydraulic release device described in U.S. Pat. No. 6,540,025 and in more detail with respect to FIGS. 6A, 6B, 6C and FIGS. 7A and 7B. For example, the release devices described herein may be coupled to the hydraulic release device and used to retain the travel joint in a locked position until the hydraulic release device is ready to be used within the wellbore, thereby avoiding the potential for unintentional unlocking of the hydraulic release device.

Figure 2A:
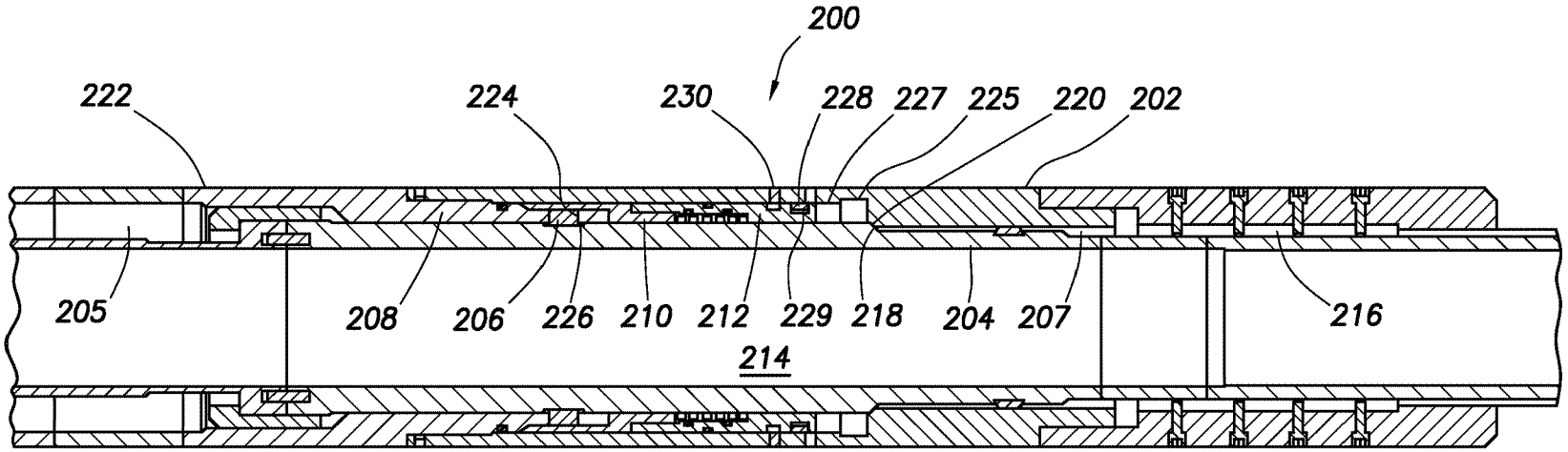
FIGS. 2A and 2B are partial cross-sectional views of an embodiment of a release device.
Figure 2B:
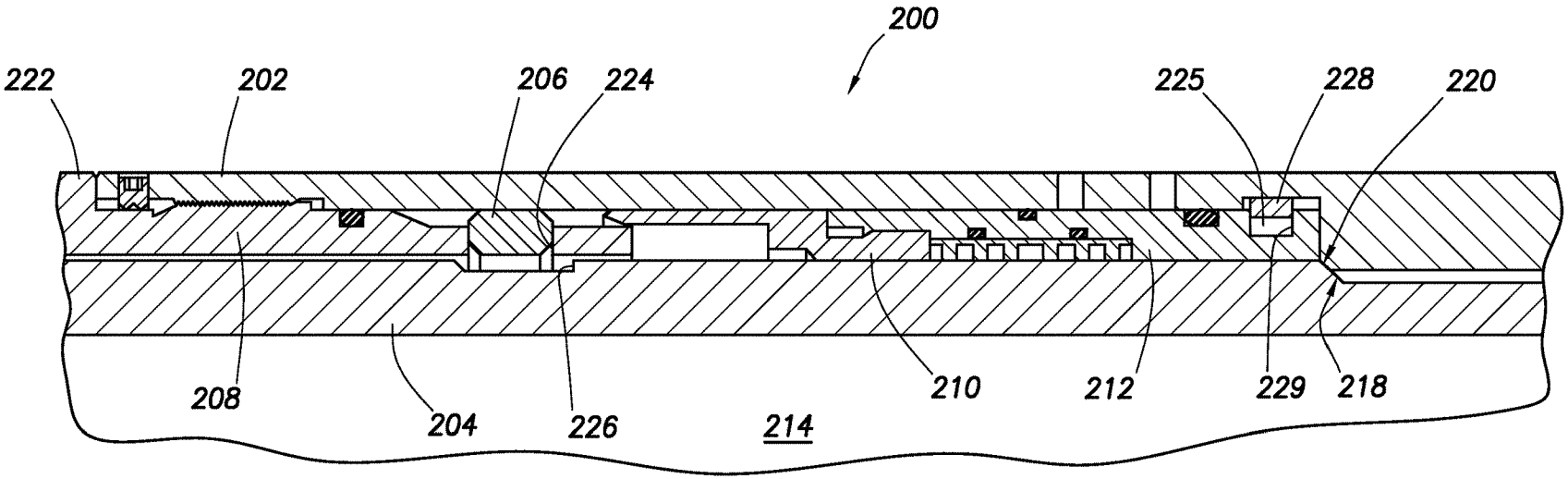

An embodiment of a release device 200 is illustrated in FIGS. 2A and 2B. The release device 200 may be used with the system 10, or it may be used with other well systems. As described in more detail below, the release device 200 comprises one or more lugs 206 configured to maintain the travel joint 24 in a locked configuration and transfer load between an inner mandrel 204 and the outer components connected to the cage sleeve 222. A sleeve 210 may maintain the lugs 206 in a locked position and the sleeve 210 may be configured to shift in response to a hydraulic pressure. An actuable device may maintain the sleeve 210 in locked position until a predetermined pressure is exceeded, and once actuated to an unlocked position, a retaining device may prevent the sleeve 210 from returning to its original, locked position. Thus, the release device 200 represents a hydraulic release device responsive to a pressure supplied to the shifting sleeve 210.

FIG. 2A illustrates the release device 200 in the travel joint section 24. In this embodiment, the travel joint section 24 comprises an outer housing 202 disposed about an inner mandrel 204. The release device 200 is configured to maintain the outer housing 202 in a relatively fixed engagement with the inner mandrel 204, except that some minor amount of travel may be permitted while still being in a locked position. The release device 200 comprises one or more lugs 206 retained within a lower end 208 of a cage sleeve 222. A retaining sleeve 210 is configured to retain the lugs 206 in engagement with a recess on the inner mandrel 204 until a piston 212 is shifted based on a hydraulic pressure.

As shown in FIG. 2A, the inner mandrel 204 is sealingly received within the outer housing 202. The inner mandrel 204 comprises a tubular body having a flowbore 214 disposed therethrough, and the inner mandrel 204 may comprise one or more sections that are coupled together to form a continuous flowbore 214. The size of the flowbore 214 may be selected to allow fluid flow therethrough at a desired rate during normal operation of the wellbore tubular string 12 and/or one or more tools or inner wellbore tubular strings to pass through the flowbore 214. The outer housing 202 also comprises a generally tubular body having an inner diameter selected to receive the inner mandrel 204. An upper end of the outer housing 202 may have suitable coupling devices or means to allow the travel joint section 24 to be coupled to one or more components. For example, the upper end of the outer housing 202 may comprise a threaded connection for coupling to an adjacent and correspondingly threaded component such as another tool or the wellbore tubular string 12. The lower end of the outer housing 202 may be configured to receive and sealingly, slidingly engage the inner mandrel 204. For example, one or more seal sections may be disposed between the inner surface of the outer housing 202 and the outer surface of the inner mandrel 204 to provide a seal. The lower end of the inner mandrel 204 may have suitable coupling devices or means to allow the travel joint section 24 to be coupled to one or more components. The connection between the inner mandrel 204 and a downhole component may comprise a flush connection to allow the outer housing 202 and any seals to slide over the coupling. For example, the first several joints of the lower portion of the wellbore tubular string below the travel joint 24 may be connected by means of a fluid joint that is internally threaded in order to be easily received within the outer housing 202 of the travel joint 24.

In an embodiment, the inner mandrel 204 is configured to be retained within the outer housing 202. The outer housing 202 may have a decreased inner radius over a lower portion, thereby forming an upward facing shoulder 220. Similarly, the inner mandrel may have a portion with an increased outer diameter, thereby forming a downward facing shoulder 218. The engagement of the shoulders 218, 220 may form a no-go type engagement between the inner mandrel 204 and the outer housing 202 to maintain the inner mandrel 204 within the outer housing 202. While illustrated as a no-go engagement, any other suitable engagement configured to retain the inner mandrel 204 within the outer housing 202 may also be used. The engagement between the inner mandrel 204 and the outer housing 202 may allow the length of the tubular string 12 to shorten when the release device 200 is actuated to the unlocked position.

A flow path 205 may be provided between the inner mandrel 204 and the outer housing 202. The flow path 205 may be in fluid communication with the flowbore 214 through a port and/or through an opening above the upper end of the inner mandrel 204. The flow path may provide fluid communication with the piston 212, as described in more detail below. A second flow path 207 may provide a fluid pathway between the outer housing 202 and the inner mandrel 204 below the piston 212 to prevent a fluid lock below the piston 212 during use. The second flow path 207 may provide fluid communication between the annulus between the inner mandrel 204 and the outer housing 202 and the exterior of the outer housing 202.

The release device 200 may be disposed between the outer housing 202 and the inner mandrel 204 and may serve to retain the outer housing 202 in a locked position with respect to the inner mandrel 204 until unlocked or released. In an embodiment, a cage sleeve 222 may sealingly engage the outer housing 202, and a lower portion of the cage sleeve 222 may extend between the outer housing 202 and the inner mandrel 204. The lower portion of the cage sleeve 222 comprises one or more circumferentially spaced lug windows 224. A plurality of lugs 206 are respectively mounted in the lug windows 224 for radial movements between a retracted position, where the lugs 206 are forced to retract into a recess 226 formed in the outer surface of the inner mandrel 204 (e.g., a circumferential channel or groove), and an expanded position, wherein the lugs 206 expand outward to be released from the recess 226. In an embodiment, one or more biasing members (e.g., leaf springs, coil springs, etc.) may bias the lugs 206 into the expanded position. In some embodiments, the edges of the lugs may be chamfered with an angle corresponding to a chamfered edge of the recess 226 such that the interaction between the chamfered edges results in a radial force for expanding the lugs.

A retaining sleeve 210 is disposed about the inner mandrel 204 in the annular region between the inner mandrel 204 and the outer housing 202. In the locked position, an upper end of the retaining sleeve 210 is configured to be radially aligned with the lugs 206 and retain the lugs 206 in the retracted position. In this position, the lugs 206 are retained in engagement with the recess 226 to prevent relative movement between the outer housing 202 and the inner mandrel 204. A compressive force on the outer housing 202 may be transferred to the inner mandrel through the cage sleeve 222, through the lugs 206, and into the inner mandrel 204 based on the interaction of the lugs 206 with the recess 226. A tensile force on the outer housing 202 is transferred to the inner mandrel 204 at the engagement of the shoulders 218, 220. The retaining sleeve 210 can be translated to an unlocked position in which the retaining sleeve 210 is not radially aligned with the lugs 206. The lugs 206 may then transition to the expanded position. In the expanded position, the inner mandrel 204 is free to axially translate with respect to the outer housing 202. For example, the inner mandrel 204 can translate upwards with respect to the outer housing 202 to allow the travel joint 24 to shorten in response to a compressive force on the outer housing 202. While described herein in terms of lugs, the release device 200 can also be used with a collet, snap ring, or other latching member that is configured to be propped into position by the retaining sleeve 210, as described in more detail herein.

The retaining sleeve 210 is engaged with a piston 212, which is slidingly, sealingly disposed in a piston chamber between the inner mandrel 204 and the outer housing 202. The piston 212 is configured to translate along the longitudinal axis of the inner mandrel 204 in response to a pressure on the piston 212. The piston 212 translates from a first position in which the retaining sleeve 210 is in the locked position and a second position in which the retaining sleeve is in the unlocked position. The piston chamber is formed between the inner mandrel 204 and the outer housing 202, which may have a multi-radius inner diameter to create a downward facing shoulder 227 at the end of the piston chamber. The piston 212 may comprise a circumferential recess 229 in an outer surface, and an outwardly biased retaining mechanism 228 may be disposed in the recess 229. When the piston 212 translates to the unlocked position, the retaining mechanism 228 may expand as it passes the shoulder 227 and thereby retain the piston in the unlocked position based on the engagement of the retaining mechanism 228 with both the shoulder 227 and the recess 229 in the piston 212. Suitable retaining mechanisms 228 can be configured to expand outward while remaining at least partially in the recess, and in an embodiment, the retaining mechanism 228 can include, but is not limited to, an outwardly biased snap ring, a collet indicator, an outwardly biased lug, or the like.

In an embodiment, an actuable device 230 can be used to retain the piston 212 in the locked position, and thereby retain the release device 200 in a locked position until a predetermined force is applied to the piston 212. A shown in FIG. 2A, the actuable device 230 can comprise a shear screw engaging the outer housing 202 and the piston 212. However, the actuable device 230 can comprise any device engaging the retaining sleeve 210 and/or piston 212 along with the outer housing 202 and/or the inner mandrel 204. Various actuable devices 230 may be used including, but not limited to, shear screws, shear pins, shear rings or the like. In addition, the actuable device 230 may comprise a biased device interacting with an indicator that requires a force above a threshold in order to compress or expand and translate past the indicator. For example, the actuable device 230 may comprise a collet indicator, a snap ring, or the like configured to interact with an indicator, each of which can require a predetermined force to release.

Operation of the release device 200 can be seen with reference to FIGS. 2A and 2B. The locked position of the release device 200 is illustrated in FIG. 2A. In this position, the retaining sleeve 210 is radially aligned with the lugs 206, and the piston 212 is retained in position by the actuable device 230. Fluid pressure can then be supplied to the upper side of the piston 212 and retaining sleeve 210 through the flow path 205. For example, a ball or dart may be disposed in the flowbore 214 to close a sleeve or engage a seat and provide fluid pressure within the flowbore 214. In an embodiment, the flow path 205 is in fluid communication with the flowbore 214, and the fluid pressure in the flowbore 214 is transmitted to the piston 212.

When a pressure greater than a threshold is provided to the piston 212, the actuable device 230 may actuate and allow the piston 212 to translate within the piston chamber. As shown in FIGS. 2A and 2B, the piston 212 and the retaining sleeve 210 may move downwards in response to the pressure. As the retaining sleeve 210 moves downwards, the retaining sleeve 210 may move out of radial alignment with the lugs 206 and allow the lugs 206 to radially extend from the retracted position to the expanded position. In this position, the lugs 206 may not engage the recess 226 in the outer surface of the inner mandrel 204, allowing the release device 200 to transition to the unlocked state.

Continued application of pressure on the piston 212 may cause the lower end of the piston 212 to translate into engagement with the upwards facing shoulder 220 on the outer housing 202. In this position, the retaining mechanism 228 may be radially aligned with the recess 225 in the inner surface of the outer housing 202, allowing the retaining mechanism 228 to radially expand into the recess 225 while remaining engaged with the recess 229 in the piston 212. The piston 212 may then be retained in the unlocked position based on the engagement with the shoulder 220 and the engagement of the retaining mechanism 228 with the shoulder 227. The release device 200 may then be configured in the unlocked position as shown in FIG. 2B. With the lugs 206 able to expand into the expanded position, the inner mandrel 204 may be free to translate with respect to the outer housing 204. In an embodiment, the inner mandrel 204 may be configured to moving upwards into the outer housing 202 while being prevented from moving downward with respect to the outer housing 202 due to the engagement of the shoulder 218 on the inner mandrel 204 with the shoulder 220 on the outer housing 202. The travel joint 24 may then be available to telescope to allow for the completion assembly to be landed in the wellhead.

Figure 3:
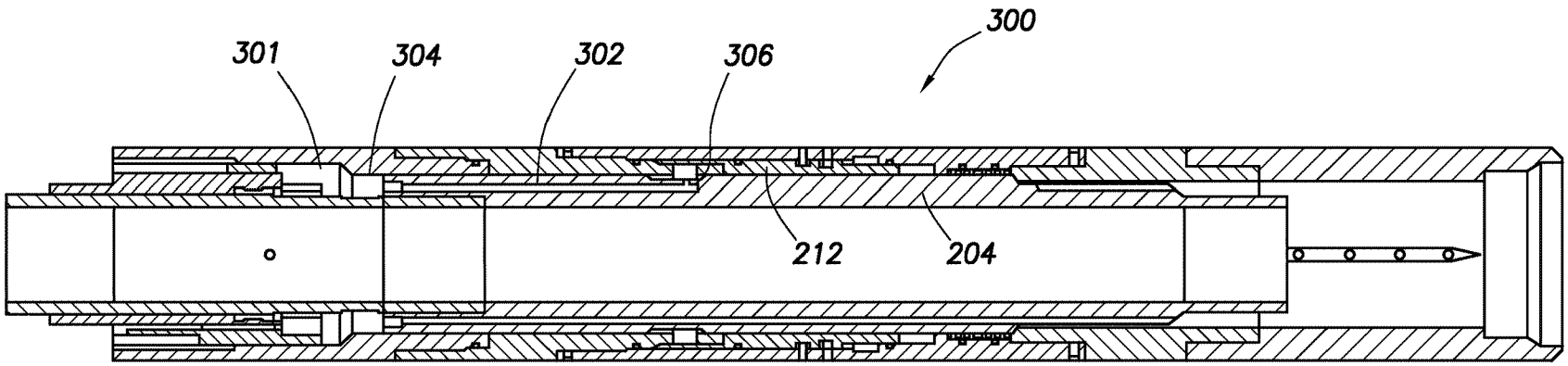
FIG. 3 is a partial cross-sectional view of an embodiment of another release device.

Another embodiment of a release device 300 is illustrated in FIG. 3A. The release device 300 may be similar to the release device 200 as illustrated and described with respect to FIGS. 2A and 2B. However, the release device 300 differs from the release device 200 in that a control line 301 may be used to provide fluid pressure to release the release device 300. As described above, multiple control lines or fluid lines may pass through the travel joint and/or the release device 300. One or more of these control lines (e.g., control line 301) may be used to supply fluid pressure to the release device 300. The control line 301 may be in fluid communication with the piston 212 through a port 302 in the inner mandrel 204. A connection 304 may serve to couple the control line 301 to the port 302. An opening 306 may provide fluid communication from the port 302 to the release device 300. The release device 300 may operate in the same manner as described with respect to the release device 200 when pressure is supplied through the control line 301 via the port 302 to actuate the release device from the locked position to the unlocked position.

Figure 4A:
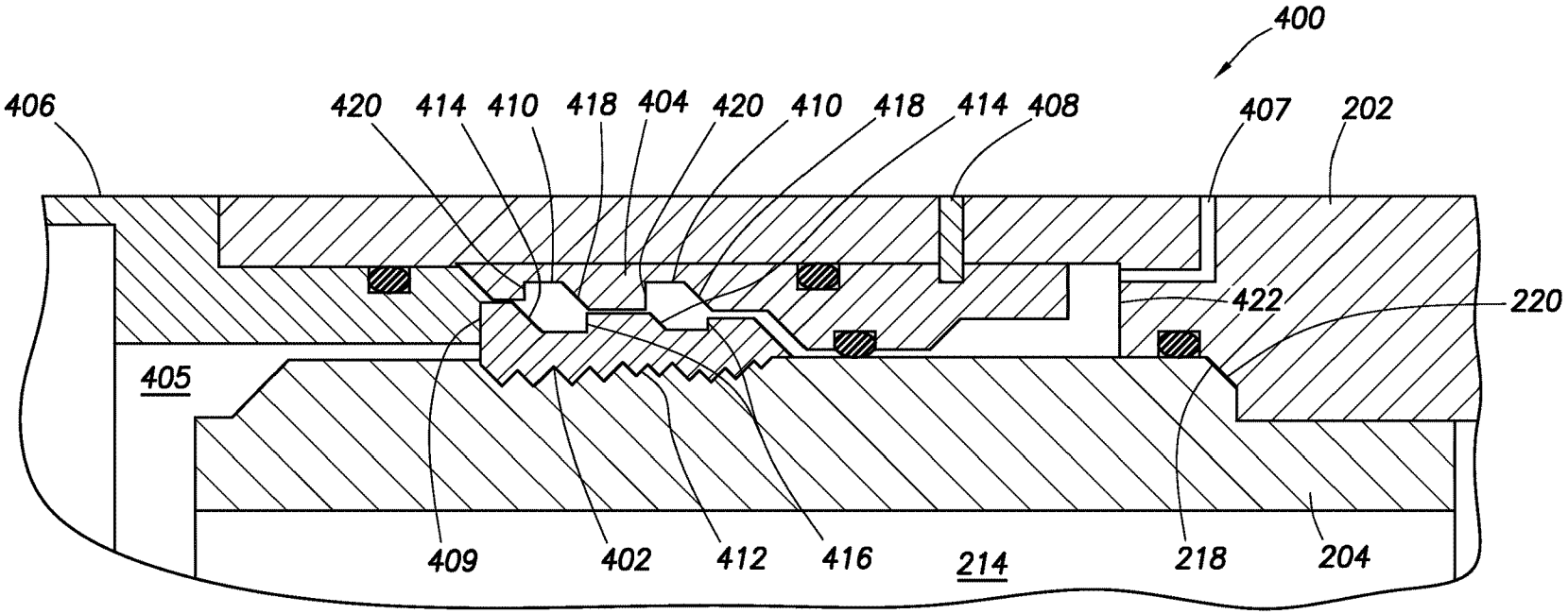
FIGS. 4A-4C are partial cross-sectional views of an embodiment of still another release device.
Figure 4B:
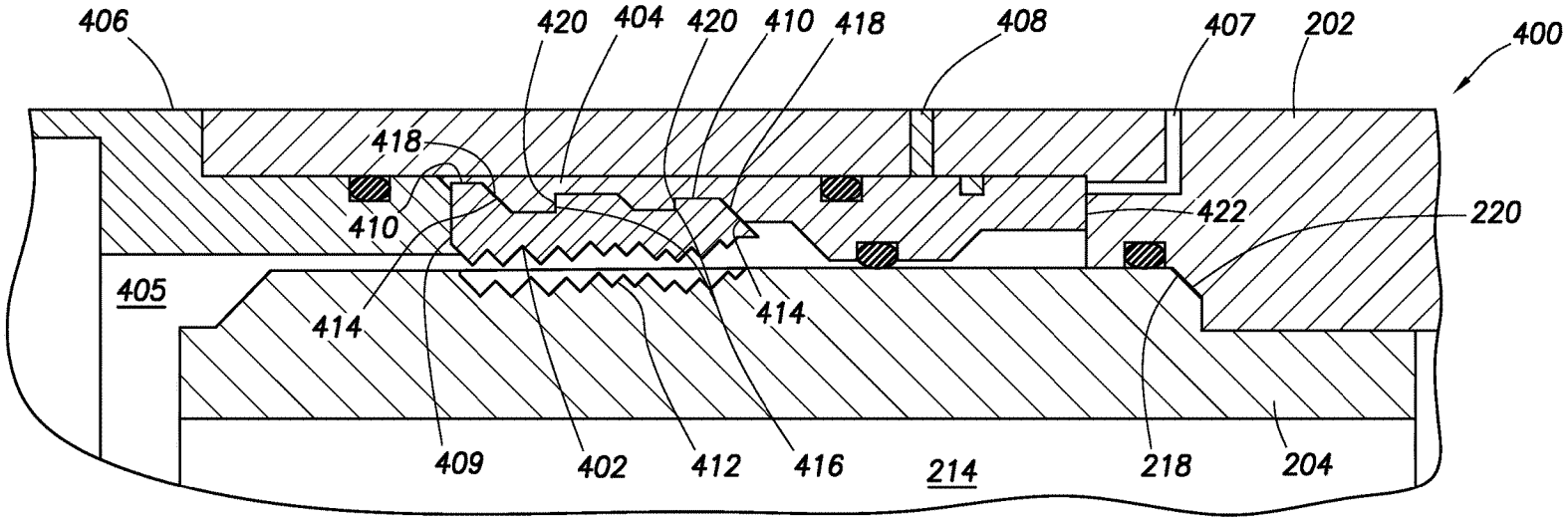

Another embodiment of a release device 400 is illustrated in FIGS. 4A and 4B. The release device 400 may be used with the system 10, or it may be used with other well systems. As described in more detail below, the release device 400 comprises a locking ring 402 that engages the inner mandrel 204 in a locked position and is retained in the locked position by a retaining sleeve 404. An actuable device 408 may retain the retaining sleeve 404 in position until a predetermined pressure is applied to the retaining sleeve 404. Once unlocked, the engagement of the locking ring 402 with the retaining sleeve 404 may maintain the retaining sleeve 404 in the unlocked position.

The release device 400 may be used with a travel joint section 24 as described above. In general, the travel joint section 24 comprises an outer housing 202 disposed about an inner mandrel 204. In the locked position, the outer housing 202 is held in a relatively fixed engagement with the inner mandrel 204, while in the unlocked position, the inner mandrel 204 may translate within the outer housing 202. In an embodiment, the inner mandrel 204 can be configured to be retained within the outer housing 202. For example, the engagement of the downward facing shoulder 218 on the inner mandrel with the upward facing shoulder 220 on the outer housing 202 may form a no-go type engagement between the inner mandrel 204 and the outer housing 202 and maintain the inner mandrel 204 within the outer housing 202. The engagement between the inner mandrel 204 and the outer housing 202 may allow the length of the tubular string 12 to shorten when the release device 200 is actuated to the unlocked position.

A flow path 405 may be provided between the inner mandrel 204 and the outer housing 202. The flow path 405 may be in fluid communication with the flowbore 214 through a port and/or through a passage above the upper end of the inner mandrel 204. In some embodiments, the flow path 405 may be in fluid communication with a control line to allow a control line pressure to be used to actuate the release device 400. The flow path 405 may provide fluid communication with the retaining sleeve 404, which may act as a piston during use. A second flow path 407 may provide a fluid pathway between the outer housing 202 and the inner mandrel 204 below the retaining sleeve 404 to prevent a fluid lock below the retaining sleeve 404 during use. The second flow path 407 may provide fluid communication between the annulus between the inner mandrel 204 and the outer housing 202 and the exterior of the outer housing 202.

The release device 400 may be disposed between the outer housing 202 and the inner mandrel 204 and may serve to retain the outer housing 202 in a locked position with respect to the inner mandrel 204 until unlocked or released. In an embodiment, an inner sleeve 406 may sealingly engage the outer housing 202, and a lower portion of the inner sleeve 406 may extend between the outer housing 202 and the inner mandrel 204. The lower portion of the inner sleeve 406 may form a downward facing shoulder 409 to engage and retain the retaining sleeve 404 and the locking ring 402 in position in the locked position, for example, during run-in of the travel joint.

Figure 4C:
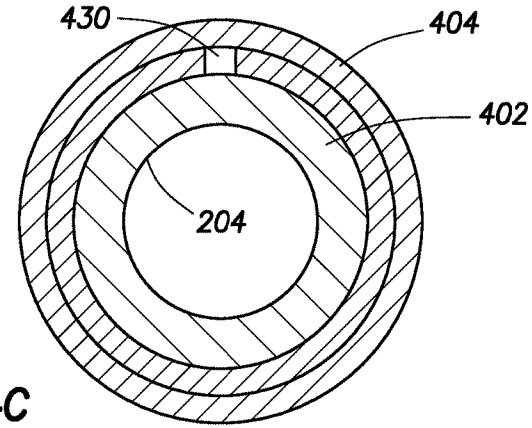

The locking ring 402 may be disposed about the inner mandrel 204. The locking ring 402 can be radially compressed to engage the outer surface of the inner mandrel 204, and upon being released, may expand to disengage from the inner mandrel 204. In an embodiment, the locking ring 402 may take the form of a c-ring as shown in FIG. 4C, where a cutout 430 is provided to allow the locking ring to radially compress. An inner surface of the locking ring 402 may comprise a series of surface features 412 such as teeth, threads, protrusions, recesses, castellations, etc. The surface features 412 of the locking ring 402 can be configured to interact with corresponding surface features on the outer surface of the inner mandrel 204 in the locked position. The surface features 412 may be of a sufficient depth, shape, and/or structure to prevent the locking ring 402 from moving relative to the outer housing 202 in the locked position. The interaction between the locking ring 402 and the shoulder 409 of the inner sleeve may prevent upward movement of the inner mandrel 204 relative to the outer housing 202 when the locking ring 402 is in the locked position. It can be seen that a compressive force (e.g., a downward directed force on the outer housing 202 relative to the inner mandrel 204) is transferred between the outer housing 202 and the inner mandrel 204 through the locking ring 402.

The outer surface of the locking ring 402 may comprise a series of recesses and/or protrusions resulting in the formation of shoulders 414, 416 that are configured to interact with corresponding recesses 410 and/or protrusions forming shoulders 418, 420 on the inner surface of the retaining sleeve 404. The downward facing edges of the shoulders 414 on the locking ring 402 may be angled to allow correspondingly angled upwards facing shoulders 418 on the inner surface of the retaining sleeve 404 to engage and compress the locking ring 402. The upwards facing shoulders 416 of the locking ring 402 and the downward facing shoulders 420 of the retaining sleeve 404 may be perpendicular to the longitudinal axis to prevent relative movement of the locking ring 402 and the retaining sleeve 404 when the shoulders 416, 420 engage.

The retaining sleeve 404 can be sealingly, slidingly disposed in an annular area between the inner mandrel 204 and the outer housing 202. The retaining sleeve 404 can translate between an engagement with the end of the inner sleeve 406 in the locked position and an engagement with the upwards facing end 422 of the outer housing 202 in the unlocked position. In the locked position, the protrusions on the retaining sleeve 404 are configured to be radially aligned with the protrusions on the locking ring 402, thereby retaining the locking ring 402 in a compressed position and in engagement with the inner mandrel 204. The retaining sleeve 404 can be translated to an unlocked position in which the protrusions on the retaining sleeve 404 are radially aligned with the recesses on the outer surface of the locking ring 402. In this position, the locking ring 402 may be expanded out of engagement with the inner mandrel 204, allowing the inner mandrel 204 to move relative to the outer housing 202.

In an embodiment, an actuable device 408 can be used to retain the retaining sleeve 404 in position, and thereby retain the release device 400 in a locked position until a predetermined force is applied to the retaining sleeve 404. The actuable device 408 can comprise any of those actuable devices described above (e.g., with respect to actuable device 230 in FIGS. 2A and 2B).

Operation of the release device 400 can be seen with reference to FIGS. 4A and 4B. The locked position is of the release device 400 is illustrated in FIG. 4A. In this position, the protrusions on the retaining sleeve 404 are radially aligned with the protrusions on the locking sleeve 402, thereby retaining the locking ring 402 in engagement with the inner mandrel 204. The retaining sleeve 404 is retained in position due to the engagement with the outer housing 202 through the actuable device 408. Fluid pressure can then be supplied to the upper side of the retaining sleeve 404 through the flow path 405. For example, a ball or dart may be disposed in the flowbore 214 to close a sleeve or engage a seat and provide fluid pressure within the flowbore 214. In an embodiment, the flow path 405 is in fluid communication with the flowbore 214, and the fluid pressure in the flowbore 214 is transmitted to the retaining sleeve 404. In some embodiments, the flow path 405 is in fluid communication with a control line, and control line pressure may be used to actuate the retaining sleeve 404.

When a pressure greater than a threshold is provided to the retaining sleeve 404, the actuable device 408 may actuate and allow the retaining sleeve 404 to translate downwards. As shown in FIG. 4B, the retaining sleeve 404 may translate downwards and the outward biasing force of the locking ring 402 may allow the locking ring 402 to expand into engagement with the retaining sleeve 404. In the unlocked or released configuration, the surface features 412 on the locking ring 402 may not engage the inner mandrel 204, and the inner mandrel 204 may be free to translate with respect to the outer housing 202. The outwards biasing force of the locking ring 402 may be sufficient to prevent the locking ring 402 from moving inwards and re-engaging the inner mandrel 204 during use.

In an embodiment, the release device 400 may be initially set or reset using fluid pressure supplied through the flow path 407. For example, a fluid connection may be coupled to the outlet of the flow path 407, and pressure may be supplied to the lower side of the retaining sleeve 404. Upon the application of a sufficient pressure, the engaging shoulders 414, 418 may result in the compression of the locking ring 402. The retaining sleeve 404 may continue to move upwards in response to the pressure and fully compress the locking ring 402 into position. The actuable device 408 may then be inserted upon the proper alignment of the retaining sleeve 404 with the outer housing 202. This method may be useful for the initial setting of the release device 400 and/or resetting the release device 400.

Figure 5A:
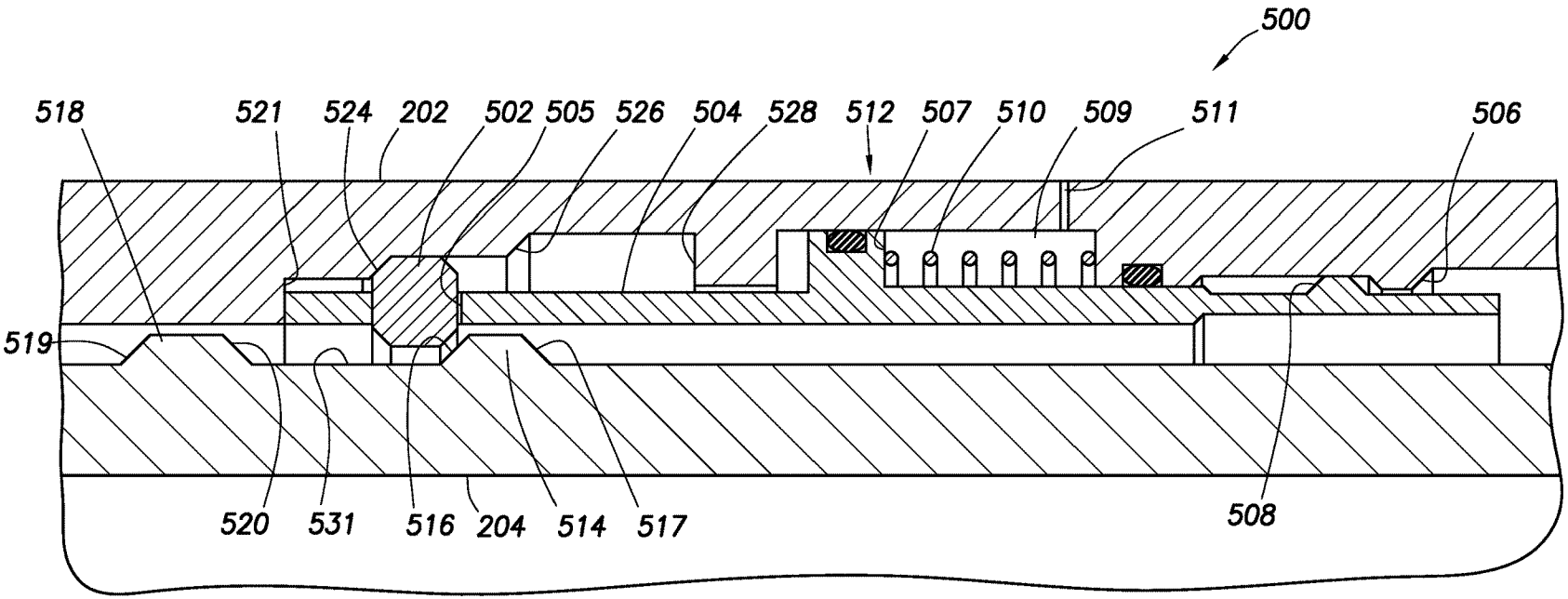
FIGS. 5A-5C are partial cross-sectional views of an embodiment of yet another another release device.
Figure 5B:
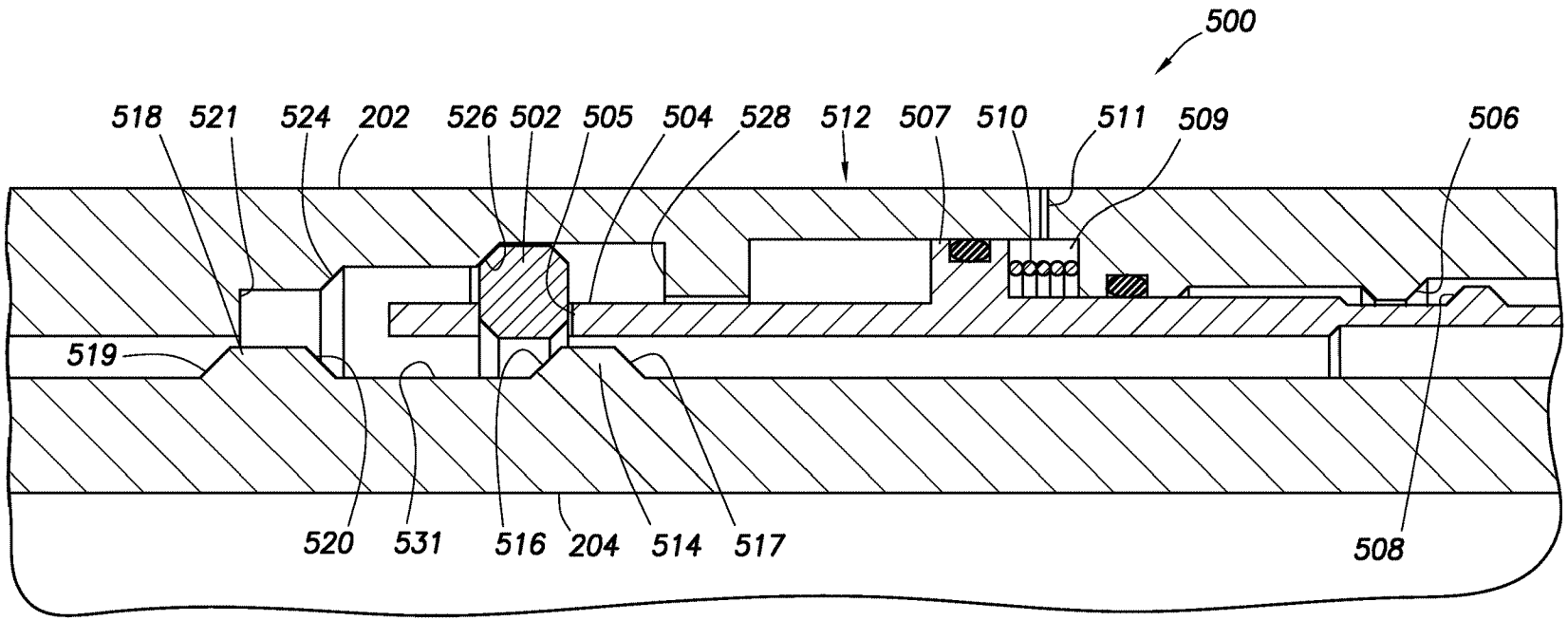
Figure 5C:
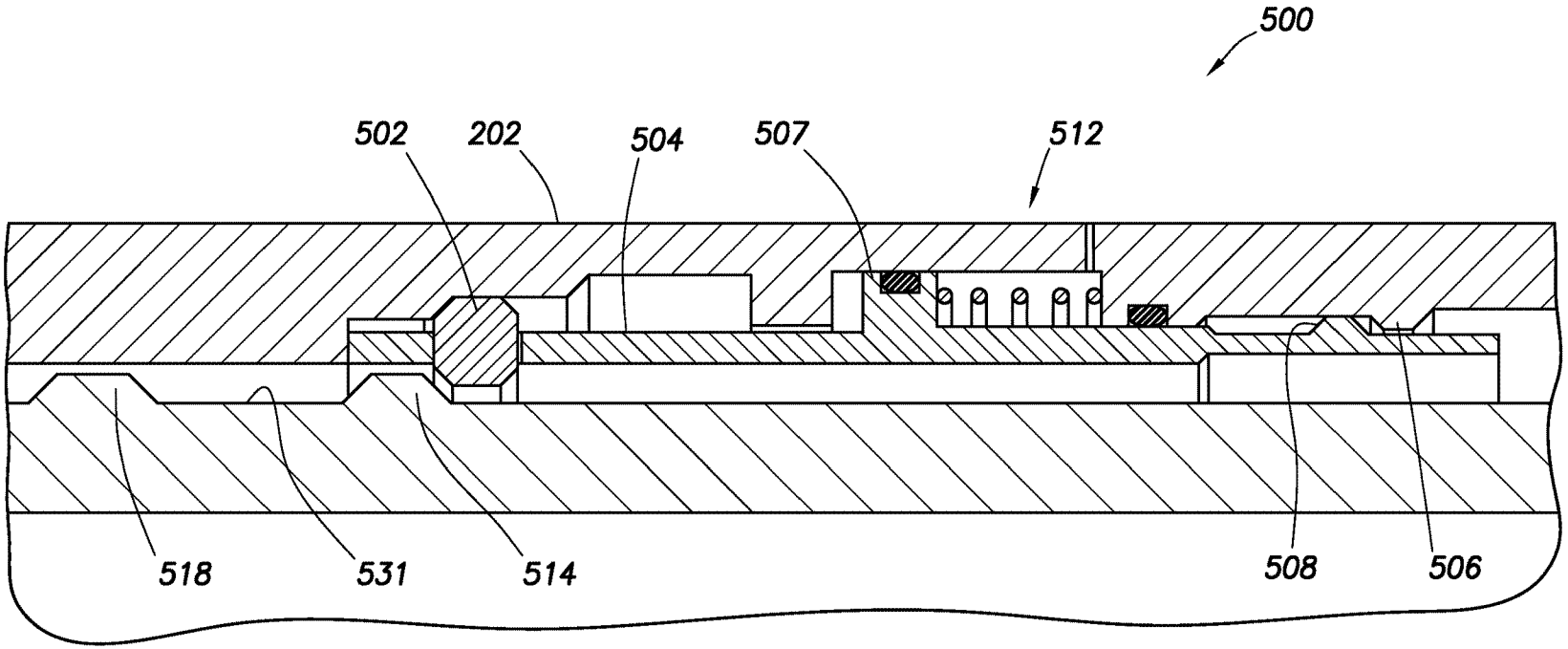

Another embodiment of a release device 500 is illustrated in FIGS. 5A to 5C. The release device 500 may be used with the system 10, or it may be used with other well systems. As described in more detail below, the release device 500 comprises locking lugs 502 that engages both the inner mandrel 204 and the outer housing 202 in a locked position, and the locking lugs 502 are retained in the locked position by a retaining sleeve 504. The interaction between an indicator 506 on the outer housing 202 and an indicator 508 on the retaining sleeve 504 may retain the lugs 502 in the locked position until a predetermined pressure is applied to the retaining sleeve 504. Once unlocked, the inner mandrel 204 may be free to axially translate with respect to the outer housing 202. Further, a biasing member 510 may be used to allow the release device 500 to be reset, thereby relocking the inner mandrel 204 to the outer housing 202.

FIG. 5A illustrates the release device 500 in the travel joint section 24. In this embodiment, the travel joint section 24 comprises an outer housing 202 disposed about an inner mandrel 204. The inner mandrel 204 can be sealingly received within the outer housing 202. The release device 200 comprises one or more lugs 502 retained within a retaining sleeve 504. The retaining sleeve 504 is configured to retain the lugs 502 in corresponding lug windows 505 so that the lugs 502 are retained in engagement with a circumferential channel 531 on the inner mandrel 204 until a piston 512, which can be formed by a portion of the retaining sleeve 504, is shifted based on a hydraulic pressure, as described in more detail below.

The retaining sleeve 504 comprises an extension 507 that sealingly, slidingly engages the outer housing 202. The retaining sleeve 504 is further sealingly, slidingly engaged with the outer housing 202 at a second location to thereby form a chamber 509 that contains the biasing member 510. The chamber 509 is in fluid communication with an exterior of the outer housing 202 such that the extension 507 acts as a piston 512 when fluid pressure is applied across the extension 507.

A lower end of the retaining sleeve 504 may comprise an indicator 508 that is configured to interact with an indicator 506 on the outer housing 202 such that a predefined force is required to shift the retaining sleeve 504 downwards to move the indicator 508 past the indicator 506. In an embodiment, the lower end of the retaining sleeve 504 may comprise a collet with a collet indicator 508 interacting with a fixed indicator 506 on the outer housing 202. While illustrated as having a collet on the retaining sleeve 504, the collet and indicator may also be formed on the inner surface of the outer housing 202 and/or the outer surface of the inner mandrel 204. Further, other retaining mechanism such as shear rings, shear pins, snap rings, the like may be used to retain the retaining sleeve 504 in position until the application of a predetermined force or pressure allows the retaining sleeve 504 to translate relative to the outer housing 202.

As shown in FIG. 5A, the outer surface of the inner mandrel 204 may comprise a first protrusion 514 forming an upwards facing shoulder 516 and a downward facing shoulder 517. A second protrusion 518 may be located above the first protrusion 514 and similarly form an upwards facing shoulder 519 and a downward facing shoulder 520. The area between the first protrusion 514 and the second protrusion 518 may form a circumferential channel 531. The outer housing 202 may comprise a multi-radiused inner surface to form downward facing shoulders 521, 524, 526 and upward facing shoulder 528. The shoulders 516, 520 on the inner mandrel 204 and the shoulders 524, 526 may comprise a shape and/or angle configured to interact with the lugs 502. In the locked position, the lug 502 may be retained in engagement with the downward facing shoulder 524 on the outer housing 202 due to the force of the biasing member 510 acting on the retaining sleeve 504. In this position, an upward force on the inner mandrel 204 may be communicated through the upward facing shoulder 516, through the lugs 502, and into the outer housing 202. A downward acting force on the inner mandrel 204 may allow the inner mandrel 204 to translate downward until the downward facing shoulder 520 engages the lugs 502. The downward directed force may be transferred through the retaining sleeve to the engaging indicators 506, 508 and/or the biasing member 510, and into the outer housing 202. The inner mandrel 204 may then be supported relative to the outer housing 202 by the retaining sleeve 504 so long as the force required to translate the indicator 508 past the indicator 506 and/or to overcome the biasing member 510 is not exceeded.

Operation of the release device 500 can be seen with reference to FIGS. 5A-5C. The locked position of the release device 500 is illustrated in FIG. 5A. In this position, the inner mandrel 204 can translate within the limits of the circumferential channel 531 defined between shoulders 516, 520 on the inner mandrel 204, but is retained in position relative to the outer housing 202 due to the engagement with the lugs 502. Fluid pressure can then be applied to the upper side of the piston 512, for example by increasing fluid pressure within the flowbore of the inner mandrel 204. For example, a ball or dart may be disposed in the flowbore to close a sleeve or engage a seat and provide fluid pressure within the flowbore. In an embodiment, the upper side of the piston 512 is in fluid communication with the flowbore, and the fluid pressure in the flowbore is transmitted to the piston 512. In some embodiments, fluid pressure may be supplied to the piston 512 through a control line.

When the pressure on the upper side of the piston 512 is greater than the pressure within the chamber 509, the piston may begin to translate the retaining sleeve 504 downwards and compress the biasing member 510. The engagement of the lugs 502 with the shoulder 516 on the inner mandrel 204 may move the inner mandrel 204 downwards relative to the outer housing 202. The retaining sleeve 504 may move downwards until the indicator 508 on the retaining sleeve 504 contacts the indicator 506 on the outer housing 202, limiting the downward travel of the retaining sleeve 504. Upon the application of a pressure differential across the piston 512 that exceeds a threshold, the collet indicator 508 may contract inwards and allow the indicator 508 to translate downwards past the indicator 506.

The continued downward movement of the retaining sleeve 504 relative to the outer housing 202 may translate the retaining sleeve 504 to the position shown in FIG. 5B. In this position, the lug windows 505 may be radially aligned with the portion of the outer housing 202 having an increased inner radius, thereby allowing the lugs 502 to expand outwards. The retaining sleeve 504 may be maintained in this position while the pressure differential is maintained across the piston 512. When the lugs 502 are radially aligned with the increased inner radius of the outer housing 202, the release device 500 may be referred to as being in the unlocked position. In this position, the inner mandrel 204 may be free to translate upward relative to the outer housing 202. As the inner mandrel 204 translates upward, the first protrusion 514 may move past the lugs 502 without engaging the lugs 502 or with only minor resistance to move the lugs 502 into the expanded position. In an embodiment, the inner mandrel 204 may be configured to moving upwards into the outer housing 202. The travel joint 24 may then be available to telescope to allow for the completion assembly to be landed in the wellhead.

The release device 500 may be resettable to allow the inner mandrel 204 to be retained in position relative to the outer housing 204. When the pressure differential across the piston 512 is removed, the biasing member 510 may bias the extension 507 upwards. In an embodiment, the biasing member 510 may provide a sufficient biasing force to translate the indicator 508 upwards and past the indicator 506. In some embodiments, the indicators 508 and 506 may be replaced with a shear device that may not resist movement of the retaining sleeve 504 after the initial actuation. The resulting configuration of the release device 500 may then be as illustrated in FIG. 5C. In an embodiment, the inner mandrel 204 may then be lowered relative to the outer housing 202. When the first protrusion 514 engages the lugs 502, the retaining sleeve 504 may be forced downwards, compressing the biasing member 510 and translating the lugs 502 downwards. When the lugs 502 are radially aligned with the increased diameter section on the outer housing 202, the lugs 502 may expand into the expanded position to allow the first protrusion to pass downwards past the lugs 502. The biasing force of the biasing member 510 may then move the lugs 502 upwards to re-engage the circumferential channel 531 between the first protrusion 514 and the second protrusion 518. In an embodiment in which the indicators 506, 508 are not present, various shoulders as described herein may be used to prevent the inner mandrel 204 from passing downwards and out of the outer housing 202. The release device 500 may then be in the configuration illustrated in FIG. 5A, and the process of actuating the release device 500 to the unlocked position may be repeated using pressure to unlock the release device 500.

Figure 6A:
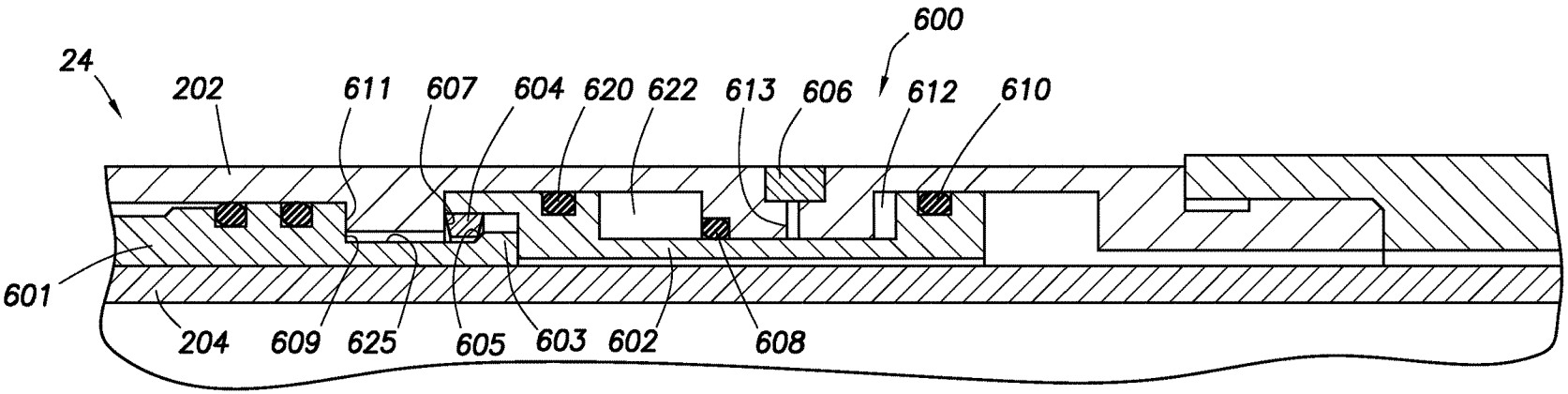
FIGS. 6A-6C are partial cross-sectional views of an embodiment of another release device.
Figure 6B:
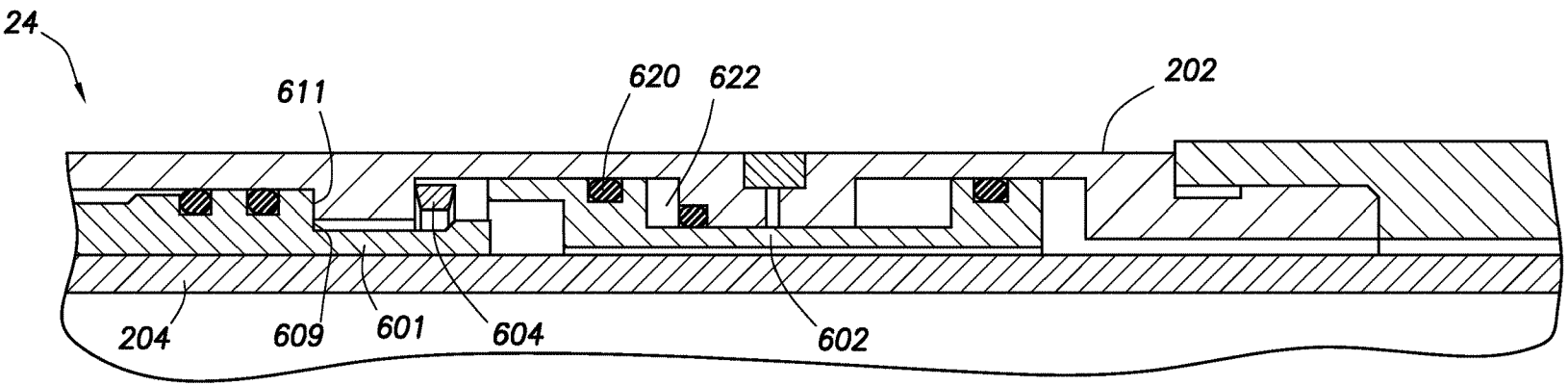
Figure 6C:
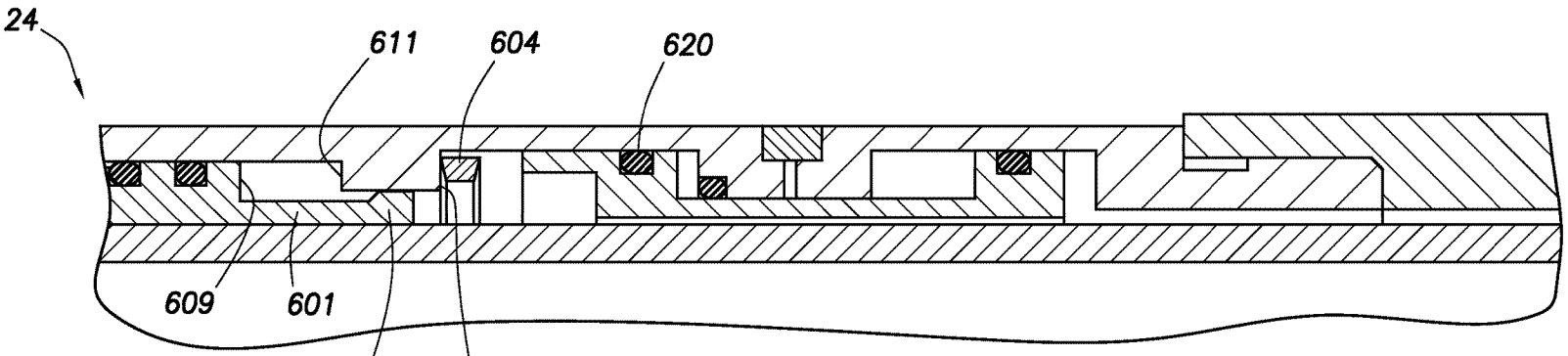

Another embodiment of a release device 600 is illustrated in FIGS. 6A to 6C. The release device 600 may be used with the travel joint release device provided by the pressure block assembly and engaging/disengaging assembly described in U.S. Pat. No. 6,540,025, which was incorporated by reference above. In some embodiments, the release device 600 may be used by itself to release a travel joint. The release device 600 may be used with the system 10, or it may be used with other well systems. As described in more detail below, the release device 600 comprises a locking ring 604 that engages both a release mandrel 601 and the outer housing 202 in a locked position and is retained in the locked position by a locking sleeve 602. The locking sleeve 602 may be retained in position by a hydrostatic lockout formed by two balanced sealed chambers 622 and 612. Upon the application of a sufficient pressure to open fluid communication with the chamber 612, the locking sleeve 602 may be translated and allow the locking ring 604 to disengage from the inner mandrel 204, thereby unlocking the release device 600.

FIG. 6A illustrates the release device 600 in the travel joint section 24. In this embodiment, the travel joint section 24 comprises an outer housing 202 disposed about an inner mandrel 204. The inner mandrel 204 can be sealingly received within the outer housing 202. The release mandrel 601 may be disposed between the inner mandrel 204 and the outer housing 202, and the release mandrel 601 may comprise a circumferential extension 603 having an increased radius. The increased radius of the circumferential extension 603 forms an upwards facing shoulder 605 and a circumferential recess 625. A locking ring 604 may be disposed about the circumferential extension 603 and engage the shoulder 605. The locking ring 604 may also have a radius configured to engage a downward facing shoulder 607 on the outer housing 202. In an embodiment, the locking ring 604 may comprise a c-ring, snap ring, or any other outwardly biased locking device. For example, the locking ring 604 may comprise a collet indicator that is propped in the inward position by the locking sleeve 602.

The engagement of the locking ring 604 with both the release mandrel 601 and the outer housing 202 may prevent relative upward translation of the release mandrel 601 and/or the inner mandrel 204 with respect to the outer housing 202. Any upward force on the release mandrel 601 and/or downward force on the outer housing 202 may be transferred through the locking ring 604. Relative downward translation of the release mandrel 601 with respect to the outer housing 202 may be prevented by the engagement of a downward facing shoulder 609 on the release mandrel 601 with an upward facing shoulder 611 on the outer housing 202. The release device 600 may be referred to as being in the locked configuration when the locking ring 605 is engaged with both the release mandrel 601 and the outer housing 202.

The locking ring 604 may be retained in the locked position by the locking sleeve 602. The locking sleeve 602 may be slidingly, sealingly engaged with the outer housing 202. An upper end of the locking sleeve 602 may be configured to radially align with the locking ring 604 and retain the locking ring 604 in the inwardly biased and locked position. The locking sleeve 602 may sealingly engage the outer housing 202 at a plurality of positions using for example, a first seal 620, a second seal 608, and a third seal 610. A chamber 622 may be defined between the outer housing 202, the locking sleeve 602, the first seal 620, and the second seal 608. A second chamber 612 may be defined between the outer housing 202, the locking sleeve 602, the second seal 608, and the third seal 610. A port 613 may provide fluid communication between the second chamber 612 and the exterior of the outer housing 202. An actuable device 606 may be configured to block flow through the port 613 until a predetermined pressure differential is established across the actuable device 606. The actuable device 606 may comprise any suitable device configured to provide fluid communication upon the application of a pressure differential above a threshold. In an embodiment, the actuable device 606 may comprise a rupture disk, burst disk, one-way valve, or the like. In the locked position, the actuable device 606 may prevent fluid communication into the chamber 612. When the actuable device 606 seals the port 613, the chamber 622 and chamber 612 are pressure balanced and may form a hydrostatic lock to prevent the locking sleeve 602 from translating with respect to the outer housing 202 and the release mandrel 601. It can be seen that no compressive or tensile loads between the release mandrel 601 and the outer housing 202 are carried through the locking sleeve 602, allowing the fluid lock to hold the locking sleeve 602 in position until the actuable device 606 is actuated.

In an embodiment, the release mandrel 601 can slidingly engage the inner mandrel 204. In this embodiment, the release device 600 may serve as a secondary locking mechanism for a travel joint. For example, the release mandrel 601 can be connected to a lug cage, and lugs retained within the lug cage can be engaged with a groove on the inner mandrel 204, such as those described in U.S. Pat. No. 6,540,025. In this embodiment, the locking ring 604 can prevent the release mandrel 601 from axially moving to release the lugs from the groove in the inner mandrel 204 until the release device 600 is unlocked. In some embodiments, the release mandrel 601 may be fixedly coupled to the inner mandrel 204. For example, the release mandrel 601 can be threadedly and sealingly engaged with the inner mandrel 204. In this embodiment, the locking ring 604 can prevent the inner mandrel 204 from axially translating until the locking ring 604 is released (e.g., the release device 600 is unlocked.

Operation of the release device 600 can be seen with reference to FIGS. 6A-6C. The locked position of the release device 600 is illustrated in FIG. 6A. In this position, the release mandrel 601 is retained with respect to the outer housing 202. In order to release the locking ring 604, fluid pressure can be applied to the exterior of the outer housing 202 (e.g., applying an annular pressure). When the pressure differential across the actuable device 606 is greater than a threshold, the actuable device 606 may actuate to provide fluid communication through port 613 and into the second chamber 612. The introduction of fluid into the chamber 612 may allow the locking sleeve to act as a piston and translate downward as the volume of fluid in the chamber 612 increases and the pressure (e.g., well pressure or annular pressure) collapses the chamber 622, which may be at approximately atmospheric pressure, in the first chamber 622. The pressure in the chamber 612 will collapse the volume in the chamber 622 until the pressure in the chamber 622 is approximately equal to the pressure in the chamber 612. This trapped volume of pressure will form a pressure lock to retain the locking sleeve 602 in the unlocked position. The resulting translation of the locking sleeve 602 may translate the upper end of the locking sleeve 602 out of radial alignment with the locking ring 604.

When the locking sleeve 602 translates a sufficient amount, the locking ring 604 may expand outward to disengage from the release mandrel 601. The resulting configuration of the release device 600 is illustrated in FIG. 6B. Once the locking ring 604 disengages from the release mandrel 601, the release device 600 may be referred to as being in the unlocked position. In an embodiment, the release mandrel 601 may be prevented from translating downwards with respect to the outer housing 202 due to the engagement of the shoulders 609, 611. However, the release mandrel 601 may be free to translate upwards with respect to the outer housing 202. In an embodiment as illustrated in FIG. 6C, the circumferential extension 603 on the release mandrel 601 may translate past the shoulder 607 on the outer housing 202. In an embodiment, the release mandrel 601 may be configured to move upwards into the outer housing 202. As described above, the release of the release mandrel 601 may allow a secondary travel joint release device to activate. For example, the release mandrel 601 may be coupled to the hydraulic release section as described in U.S. Pat. No. 6,540,025, which may be allowed to operate upon the unlocking of the release device 600. Alternatively, the release device 600 may be used alone to release the inner mandrel 204 along with the release mandrel 601. Once the release device 600 and any optional, additional release mechanisms have been unlocked, the travel joint 24 may then be available to telescope to allow for the completion assembly to be landed in the wellhead.

Figure 7A:
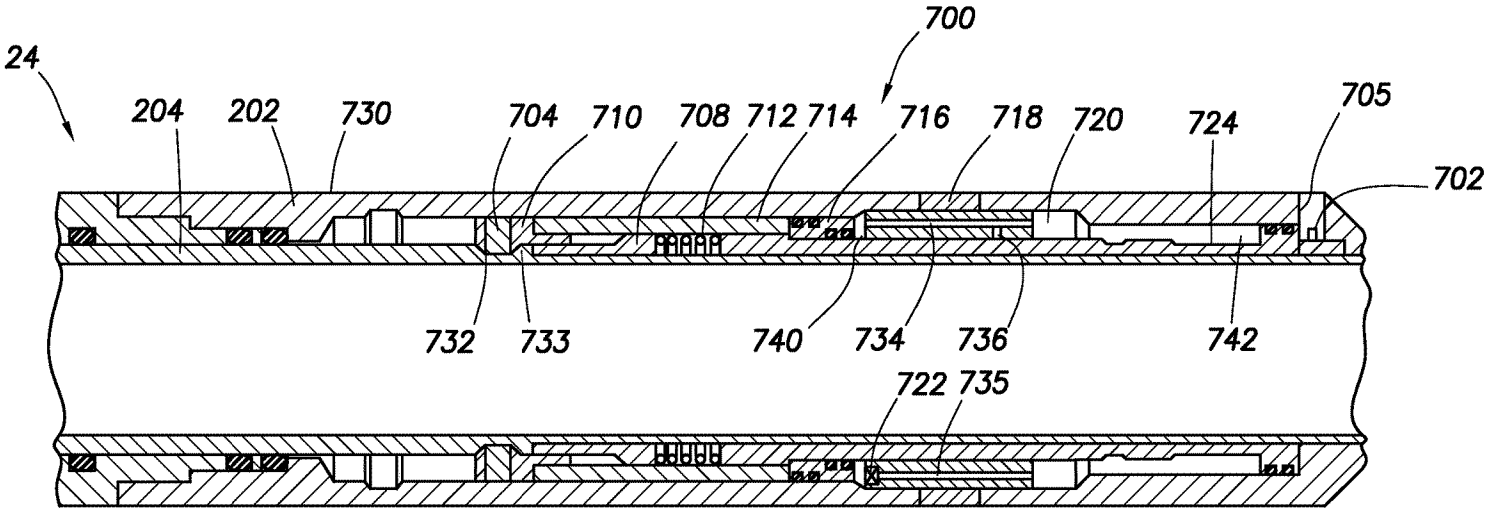
FIGS. 7A and 7B are partial cross-sectional views of an embodiment of a release device.
Figure 7B:
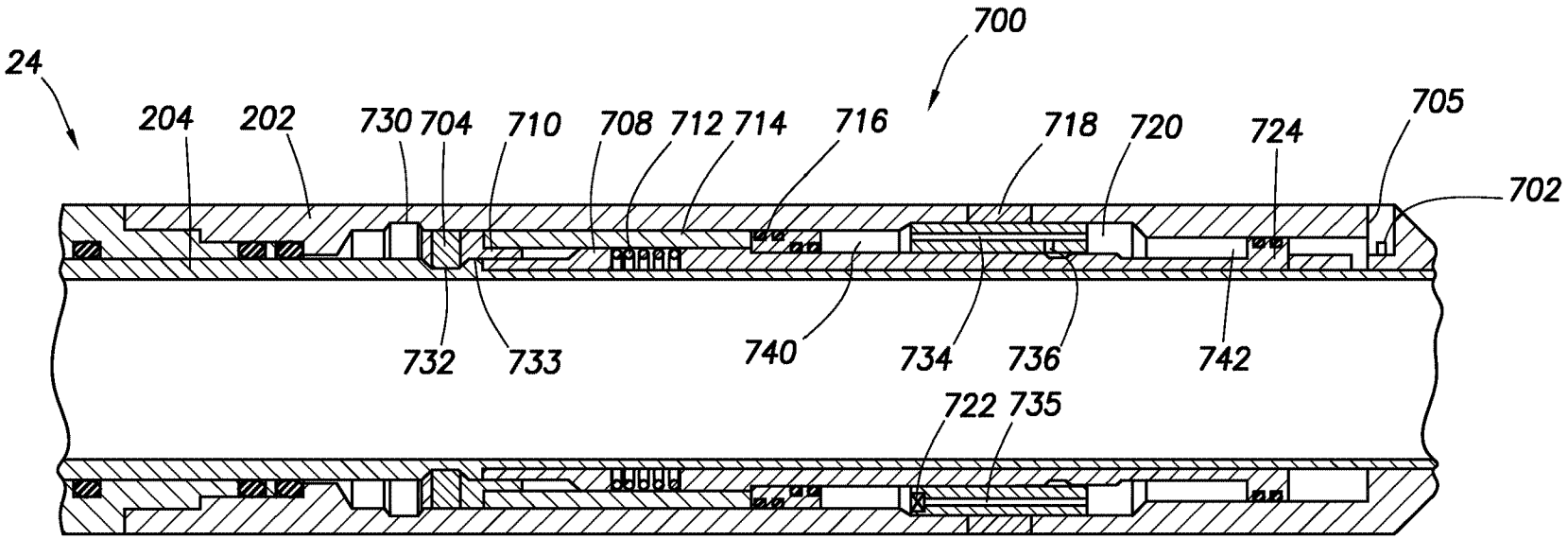

Still another embodiment of a release device 700 is illustrated in FIGS. 7A and 7B. The release device 700 is similar to the travel joint release device provided by the pressure block assembly and engaging/disengaging assembly described in U.S. Pat. No. 6,540,025, which was incorporated by reference above. In this embodiment, the release device 700 may comprise a hydraulically actuated release mechanism and an actuable device 702 coupling the inner mandrel 204 to the outer housing 202. The actuable device 702 is configured to retain the release device 700 in the locked position until a predetermined for is applied to actuate the actuable device 702. Once the actuable device 702 has been actuated, the hydraulically metered release mechanism can operate to transition the release device from the locked position to the unlocked position based on applying a constant vertical or downward force on the tubing string.

As described in more detail in U.S. Pat. No. 6,540,025, the travel joint generally comprises the outer housing 202, the inner mandrel 204, a pressure block assembly, an engaging/disengaging assembly, and an actuable device 702. The pressure block assembly controls the flow of hydraulic fluid between upper hydraulic chamber 740 and lower hydraulic chamber 742. The pressure block assembly comprises a pressure block 718, a pressure relief and restrictor valve 720, an unlock channel 734, a pressure relief port 736, a lock channel 735, a check valve 722, and a plurality of O-rings used for hydraulically isolating the pressure block assembly. In an embodiment, the pressure relief and restrictor valve 720 is a viscosity independent, pressure activated restrictor valve. The pressure relief and restrictor valve 720 comprises a pressure sensitive valve that requires a threshold pressure to be overcome before hydraulic fluid will flow across the valve. Once threshold pressure is exceeded, a steady rate of flow is achieved regardless of the viscosity of the hydraulic fluid. A steady rate of flow translates into a steady and predictable rate of movement for outer housing 202 with respect to the inner mandrel 204. The predictable rate of movement leads to a predictable time for unlocking the release device 700.

The engaging/disengaging assembly is configured to engage and disengage locking lugs 704 in the locked or unlocked positions. The lug carrier 710, which can be threaded onto lug carrier connector 714, which is in turn threaded to transfer piston 724, can be used to retain the locking lugs 704. In an embodiment, a lug support 708 and a support spring 712 can mechanically cooperating with lugs 704 and lug carrier 710. Finally, the engaging assembly can include a floating piston 716 and inner and outer O-rings. The floating piston 716 is disposed in a radial cavity defined by the inner wall of outer housing 202, the outer wall of transfer piston 724, the lower portion of lug carrier connector 714, and the upper portion of pressure block 718. Hydraulic fluid contained in upper hydraulic chamber 740 is hydraulically isolated by a plurality of O-rings. Lower hydraulic chamber 742 is defined by the inner wall of outer housing 202, the outer wall of transfer piston 724, the lower portion of pressure block 718, and an upper facing portion of transfer piston 724. Hydraulic fluid contained in lower hydraulic chamber 742 is also hydraulically isolated by a plurality of O-rings.

An end of the transfer piston 724 may extend downwards between the outer housing 202 and the inner mandrel 204. An access port 705 may be formed in the outer housing 202 and used to insert the actuable device into engagement with the transfer piston 724 and the outer housing 202 and/or the inner mandrel 204. The actuable device 702 may comprise any of the actuable devices described herein, including a shear pin, shear screw, shear ring, or the like. In an embodiment, the actuable device 702 may also comprise one or more inwardly or outwardly biased members configured to interact with an indicator or recess on the outer housing 202. For example, the actuable device 702 may comprise a collet indicator or snap ring configured to interact with an indicator and allow relative motion between the transfer piston and the outer housing 202 upon the application of a predetermined force.

The assemblies discussed above cooperate to lock and unlock inner mandrel 204 relative to the outer housing 202. In the locked position, inner mandrel 204 is locked in position within the axial annular space of the inner wall of outer mandrel 202. The interior diameter of outer mandrel 202 is sufficient to allow the exterior diameter of both inner mandrel 204 and any wellbore tubular coupled below the inner mandrel 204 to freely move in the vertical motion, telescoping, once the travel joint 24 is unlocked. To prevent the inner mandrel 204 from undesired telescoping within the outer housing 202, the locking lugs 704 are radially spaced around the outer diameter of inner mandrel 204 and within the inner diameter of outer housing 202. When release device 700 is in the locked position, the locking lugs 704 are received within locking slot 732.

In use, the release device 700 can be used to unlock the travel joint based on an actuating force to actuate the actuable device 702 followed by an applied force to actuate the hydraulic release mechanism. The locked position is illustrated in FIG. 7A. In the locked position, the actuable device 702 is engaged with the outer housing 202 and the inner mandrel 204 through the transfer piston 724. In addition, the lugs 704 are seated within locking slot 732. The lug carrier 710 is situated between the interior diameter of the outer housing 202 and the exterior diameter of the inner mandrel 204, and the lugs 704 are radially disposed between lug grooves formed in lug carrier 710. A lug support is pressed firmly against the locking slot lower shoulder 733 due to the support spring 712 being in the fully compressed position, thereby exerting an upwards force. The floating piston 716 is in a lower position, which reduces the volume of the upper hydraulic chamber 740. Conversely, the lower hydraulic chamber 742 has a larger capacity. Rather than completely filling the lower chamber 742 with hydraulic fluid, the amount of hydraulic fluid can be used in slightly less than the capacity of lower chamber 742 in order to compensate for thermal expansion in the wellbore.

In order to actuate the release device 700, a downward force can be applied on the outer housing 202 relative to the inner mandrel 204. Initially, the downward force is supported through the actuable device 702 such that the force is transferred from the outer housing 202, through the transfer piston 724, and into the inner mandrel through the lugs 704. The actuable device 702 can be used to prevent the unintentional movement or actuation of the hydraulic release mechanism during conveyance and installation within the wellbore. In order to actuate the actuable device 702, a downward force can be applied to the outer housing 202 above a threshold sufficient to actuate the actuable device 702. In an embodiment, the downward force may cause the actuable device 702 to fail, thereby disengaging the outer housing 202 from the inner mandrel 204. In some embodiments, the downward force may cause the actuable device to release the engagement between the transfer piston 724 and the outer housing 202 and/or the inner mandrel 204 without failing, for example by allowing a collet or snap ring to radially contract or expand relative to an indicator.

Once the actuable device 702 has been actuated, the downward force may increase the pressure inside the lower hydraulic chamber above the pressure threshold of the pressure relief and restrictor valve 720. Such force can cause the outer housing 202 and the pressure block 718 to move downward with respect to the transfer piston 724. Dynamic flow of the hydraulic fluid from lower hydraulic chamber 742 to upper hydraulic chamber 740 can then occur when the pressure inside the lower hydraulic chamber exceeds the pressure threshold of the pressure relief and restrictor valve 720. Once the pressure within the lower hydraulic chamber 742 exceeds the threshold pressure of the pressure relief and restrictor valve 720, flow occurs from the lower chamber to the upper chamber via the unlock channel 734.

When a sufficient amount of hydraulic fluid has transferred from the lower hydraulic chamber 742 to the upper hydraulic chamber 740, the release device 700 may be in the unlocked position, which is illustrated in FIG. 7B. In the unlocked position, inner mandrel 204 is released relative to the outer housing 202. In this configuration, the outer housing 202 and the pressure block 718 remain in their downward positions, having forced the transfer of the hydraulic fluid from the lower hydraulic chamber 742 to the upper hydraulic chamber 240, the fluid flow having occurred by simultaneously reducing the volume of capacity of lower hydraulic chamber 742 while increasing the volume of the upper hydraulic chamber 740 a corresponding amount. Pressure between the upper and lower hydraulic chambers can then be equalized based on the alignment of pressure relief slot and pressure relief port 736. The locking slot lower shoulder 733 has moved upward with respect to the lug 704, allowing the lug support 708 to reposition itself under both the lug 704 and the lug carrier 710 due to the upward force provided by the decompression of support spring 712. The release device 700 can be referred to as being in the unlocked position when the lugs 704 are received within release slot 730. In this position, the lugs 704 are expanded radially outward and are positioned between the inner wall of outer housing 202 and the outer wall of the lug support 708, filling release slot 730. In the unlocked position, the inner mandrel 204 can then telescope within the outer housing 202.

In an embodiment, the release device 700 can be reset by repositioning the inner mandrel in the initial position relative to the outer housing 202 and applying a tension across the travel joint. In most cases, the tension needed to lock the release device 700 is a force only slightly higher than that needed to compress the support spring 712, overcome the friction of the internal seals, and overcome the minimal hydraulic resistance of the check valve.

In an embodiment, the release devices described herein may be used to install a wellbore tubular string comprising a travel joint. Returning to FIG. 1, the wellbore tubular string 12 can be stabbed into a completion assembly 18 previously installed in a wellbore 20. For example, the wellbore tubular string 12 can be sealingly received in a packer 22 at an upper end of the completion assembly 18. In some embodiments, the wellbore tubular string 12 can have a seal stack thereon which seals within a sealed bore receptacle (e.g., above a liner hanger, etc.).

Once the wellbore tubular string 12 has been connected to the completion assembly 18, a travel joint 24 in the wellbore tubular string 12 can be used to allow the wellbore tubular string 12 to be landed in the wellhead 16. As illustrated in FIG. 1, a hanger 26 can be landed on a wear bushing 28, or alternatively, other manners of securing a tubular string in a wellhead may be used in keeping with the scope of this disclosure. The hanger 26 may be allowed to engage the wear bushing 28 once the travel joint 24 is released. The travel joint 24 permits some variation in the length of the wellbore tubular string 12 between the hanger 26 and the completion assembly 18. In some embodiments, the travel joint 24 can be used to allow the length of the tubular string 12 to shorten after the completion assembly 18 has been sealingly engaged, so that the hanger 26 can be appropriately landed in the wellhead 16.

The travel joint 24 may be released in a number of ways. In an embodiment, a pressure may be applied to the interior of the wellbore tubular string 12. The pressure may be used to translate a sleeve or piston, which can in turn release a retaining member such as a lug, locking ring, snap ring, or the like. In some embodiments, a pressure may be applied to the exterior of the travel joint 24. In still other embodiments, the pressure may be supplied through a control line.

Once the travel joint 24 has been released, the travel joint may be free to telescope and allow a tool associated the wellbore tubular string to engage the completion assembly. In some embodiments, the release of the release device may allow a hydraulic release mechanism to be engaged. For example, once the inner mandrel 204 is free to translate with respect to the outer housing 202, a constant force may be applied to the wellbore tubular string for a predetermined amount of time to actuate a hydraulic release mechanism. The hydraulic release mechanism may serve to fully release the travel joint and allow a tool associated the wellbore tubular string to engage the completion assembly.

Having described the various tools, systems, and method herein, embodiments may include, but are not limited to:

In some embodiments, the one or more release devices may be actuated using pressure, which may be supplied through an interior of the tubing.

In a first embodiment, a travel joint comprises an outer housing, an inner mandrel slidingly disposed within the outer housing, and a release device positioned between the outer housing and the inner mandrel. The release device comprises a plurality of lugs, and the plurality of lugs is configured to prevent relative axial movement between the outer housing and the inner mandrel in a locked position and allow relative axial movement between the outer housing and the inner mandrel in an unlocked position. The release device is configured to selectively prevent and allow relative axial movement between the outer housing and the inner mandrel in response to a fluid pressure supplied to the release device from a flowbore of the outer housing or a flowbore of the inner mandrel. In a second embodiment, the release device of the first embodiment may also include a sleeve configured to radially align with the plurality of lugs in the locked position and axially translate out of radial alignment with the plurality of lugs in the unlocked position, where the sleeve can be configured to axially translate in response to the fluid pressure. In a third embodiment, the travel joint of the second embodiment may also include an actuable device configured to maintain the sleeve in the locked position until the fluid pressure exceeds a predetermined fluid pressure. In a fourth embodiment, the travel joint of the second or third embodiment may also include a retaining device configured to retain the sleeve in the unlocked position when the sleeve is axially translated out of radial alignment with the plurality of lugs. In a fifth embodiment, the plurality of lugs of any of the second to fourth embodiment may be retained within lug windows in a cage sleeve, and the cage sleeve may be coupled to the outer housing. In a sixth embodiment, the plurality of lugs of the fifth embodiment may be configured to engage a circumferential recess on an outer surface of the inner mandrel. In a seventh embodiment, the travel joint of the second embodiment may also include a hydraulically metered release device, the the hydraulically metered release device may be configured to selectively prevent and allow relative axial movement between the outer housing and the inner mandrel. In an eighth embodiment, the release device of the first embodiment may also include a retaining sleeve configured to maintain the plurality of lugs in engagement with the outer housing and the inner mandrel in the locked position and axially translate the plurality of lugs out of engagement with the inner mandrel in the unlocked position.

In a ninth embodiment, the release device of the eighth embodiment may also include a first indicator configuration to engage a second indicator on the outer housing, and the first indicator may be configured to translate past the second indicator in response to a fluid pressure above a threshold. In a tenth embodiment, the retaining sleeve of the eighth or ninth embodiment may be coupled to a piston, and the piston may be configured to translate the retaining sleeve from the locked position to the unlocked position in response to the fluid pressure. In an eleventh embodiment, the release device of the tenth embodiment may also include a biasing member, and the biasing member may be configured to translate the retaining sleeve from the unlocked position to the locked position in response to the fluid pressure being removed from the piston. In a twelfth embodiment, the release device of any of the eighth to eleventh embodiments may be configured to reset from the unlocked position to the locked position.

In a thirteenth embodiment, a travel joint comprises an outer housing, an inner mandrel slidingly disposed within the outer housing, and a release device positioned between the outer housing and the inner mandrel. The release device comprises an outwardly biased locking ring, where the locking ring is configured to radially compress and engage the inner mandrel in a locked position and radially expand and disengage from the inner mandrel in an unlocked position. The release device is configured to selectively prevent and allow relative axial movement between the outer housing and the inner mandrel in response to a fluid pressure supplied to the release device from a flowbore of the outer housing or a flowbore of the inner mandrel. In a fourteenth embodiment, the locking ring of the thirteenth embodiment may include surface features on an interior surface, and the surface features may be configured to engage corresponding surface features on an exterior surface of the inner mandrel when the release device is in the locked position. In a fifteenth embodiment, the locking ring of the thirteenth or fourteenth embodiment may comprise a c-ring. In a sixteenth embodiment, the release device of any of the thirteenth to fifteenth embodiments may also include a retaining sleeve disposed about the locking ring, and the retaining sleeve may be configured to retain the locking ring in engagement with the inner mandrel in the locked position and axially translate to allow the locking ring to radially expand in the unlocked position.

In a seventeenth embodiment, a method of releasing a travel joint comprises preventing relative axial movement between an outer housing and an inner mandrel in a travel joint, providing a fluid pressure to a flowbore of the outer housing or a flowbore of the inner mandrel of the release device in a locked position, actuating the release device from the locked position to an unlocked position based on the fluid pressure, and allowing relative movement between the outer housing and the inner mandrel when the release device is in the unlocked position. The release device is disposed between the outer housing and the inner mandrel in a travel joint. In an eighteenth embodiment, the method of the seventeenth embodiment may also include telescoping the inner mandrel within the outer housing, and landing a tool associated with the travel joint in a wellbore in response to the telescoping. In a nineteenth embodiment, actuating the release device from the locked position to the unlocked position in the seventeenth or eighteenth embodiment may comprise shifting a sleeve out of radial alignment with a plurality of lugs, and radially shifting the plurality of lugs out of engagement with at least one of the outer housing or the inner mandrel. The plurality of lugs may prevent relative axial movement between the outer housing and the inner mandrel when the sleeve is radially aligned with the plurality of lugs. In a twentieth embodiment, the method of the nineteenth embodiment may also include engaging a retaining member with the sleeve and at least one of the outer housing or the inner mandrel in response to the shifting of the sleeve, and retaining the sleeve is the shifted position when the retaining member engages both the sleeve and the at least one of the outer housing or the inner mandrel. In a twenty first embodiment, actuating the release device from the locked position to the unlocked position in the seventeenth embodiment may comprise shifting a retaining ring in response to the fluid pressure, radially expanding a locking ring in response to shifting the retaining ring, and disengaging the locking ring from the inner mandrel when radially expanded. In a twenty second embodiment, shifting the retaining ring in the twenty first embodiment may comprise actuating an actuable device in response to the fluid pressure exceeding a threshold. In a twenty third embodiment, actuating the release device from the locked position to the unlocked position in the seventeenth embodiment may comprise axially shifting a plurality of lugs in response to providing the fluid pressure, radially expanding the plurality of lugs after axially shifting the plurality of lugs, and disengaging the plurality of lugs from the inner mandrel in response to the radial expansion. In a twenty fourth embodiment, actuating the release device from the locked position to the unlocked position in the seventeenth embodiment may comprise shifting a locking sleeve out of radial alignment with a locking ring in response to providing the fluid pressure, radially expanding the locking ring, and disengaging the locking ring from the inner mandrel when the locking ring is radially expanded. The locking ring is engaged with the outer housing and the inner mandrel.

In some embodiments, the one or more release devices may be actuated using control line pressure, which may be supplied through a control line coupled to a release device.

In a twenty fifth embodiment, a travel joint comprises an outer housing, an inner mandrel slidingly disposed within the outer housing, and a release device positioned between the outer housing and the inner mandrel. The release device comprises a plurality of lugs, where the plurality of lugs is configured to prevent relative axial movement between the outer housing and the inner mandrel in a locked position and allow relative axial movement between the outer housing and the inner mandrel in an unlocked position. The release device is configured to selectively prevent and allow relative axial movement between the outer housing and the inner mandrel in response to a fluid pressure supplied to the release device from a control line. In a twenty sixth embodiment, the release device of the twenty fifth embodiment may also include a sleeve configured to radially align with the plurality of lugs in the locked position and axially translate out of radial alignment with the plurality of lugs in the unlocked position. The sleeve may be configured to axially translate in response to the fluid pressure. In a twenty seventh embodiment, the travel joint of the twenty six embodiment may also include an actuable device configured to maintain the sleeve in the locked position until the fluid pressure exceeds a predetermined fluid pressure. In a twenty eighth embodiment, the travel joint of the twenty sixth or twenty seventh embodiment may also a retaining device configured to retain the sleeve in the unlocked position when the sleeve is axially translated out of radial alignment with the plurality of lugs. In a twenty ninth embodiment, the plurality of lugs of any of the twenty sixth to twenty eighth embodiments may be retained within lug windows in a cage sleeve, and the cage sleeve may be coupled to the outer housing. In a thirtieth embodiment, the plurality of lugs of the twenty ninth embodiment may be configured to engage a circumferential recess on an outer surface of the inner mandrel. In a thirty first embodiment, the travel joint of the twenty sixth embodiment may also include a hydraulically metered release device, and the hydraulically metered release device may be configured to selectively prevent and allow relative axial movement between the outer housing and the inner mandrel. In a thirty second embodiment, the release device of the twenty fifth embodiment may also include a retaining sleeve configured to maintain the plurality of lugs in engagement with the outer housing and the inner mandrel in the locked position and axially translate the plurality of lugs out of engagement with the inner mandrel in the unlocked position. In a thirty third embodiment, the release device of the thirty second embodiment may also include a first indicator configuration to engage a second indicator on the outer housing, and the first indicator may be configured to translate past the second indicator in response to a fluid pressure above a threshold. In a thirty fourth embodiment, the retaining sleeve of the thirty second or thirty third embodiment may be coupled to a piston, and the piston may be configured to translate the retaining sleeve from the locked position to the unlocked position in response to the fluid pressure. In a thirty fifth embodiment, the release device of the thirty fourth embodiment may also include a biasing member, and the biasing member may be configured to translate the retaining sleeve from the unlocked position to the locked position in response to the fluid pressure being removed from the piston. In a thirty sixth embodiment, the release device of any of the thirty second to thirty fifth embodiments may be configured to reset from the unlocked position to the locked position. In a thirty seventh embodiment, the travel joint of the twenty fifth embodiment may also include a plurality of control lines disposed between the outer housing and the inner mandrel, and the control line may comprise one of the plurality of control lines. In a thirty eighth embodiment, the plurality of control lines of the thirty seventh embodiment may comprise a fluid line, an electrical conductor, a fiber optic line, or any combination thereof.

In a thirty ninth embodiment, a travel joint comprises an outer housing, an inner mandrel slidingly disposed within the outer housing, and a release device positioned between the outer housing and the inner mandrel. The release device comprises an outwardly biased locking ring, where the locking ring is configured to radially compress and engage the inner mandrel in a locked position and radially expand and disengage from the inner mandrel in an unlocked position. The release device is configured to selectively prevent and allow relative axial movement between the outer housing and the inner mandrel in response to a fluid pressure supplied to the release device from a surface of a wellbore. In a fortieth embodiment, the locking ring of the thirty ninth embodiment may comprise surface features on an interior surface, and the surface features may be configured to engage corresponding surface features on an exterior surface of the inner mandrel when the release device is in the locked position. In a forty first embodiment, the locking ring of the thirty ninth or fortieth embodiment may comprise a c-ring. In a forty second embodiment, the release device of any of the thirty ninth to forty first embodiments may also include a retaining sleeve disposed about the locking ring, and the retaining sleeve may be configured to retain the locking ring in engagement with the inner mandrel in the locked position and axially translate to allow the locking ring to radially expand in the unlocked position.

In a forty third embodiment, a method of releasing a travel joint comprises preventing relative axial movement between an outer housing and an inner mandrel in a travel joint, providing a fluid pressure through a control line when the release device in a locked position, actuating the release device from the locked position to an unlocked position based on the fluid pressure, and allowing relative movement between the outer housing and the inner mandrel when the release device is in the unlocked position. The release device is disposed between the outer housing and the inner mandrel in a travel joint. In a forty fourth embodiment, the method of the forty third embodiment may also include telescoping the inner mandrel within the outer housing; and landing a tool associated with the travel joint in a wellbore in response to the telescoping. In a forty fifth embodiment, actuating the release device from the locked position to the unlocked position in the forty third or forty fourth embodiment may comprise shifting a sleeve out of radial alignment with a plurality of lugs, and radially shifting the plurality of lugs out of engagement with at least one of the outer housing or the inner mandrel. The plurality of lugs may prevent relative axial movement between the outer housing and the inner mandrel when the sleeve is radially aligned with the plurality of lugs. In a forty six embodiment, the method of the forty fifth embodiment may also include engaging a retaining member with the sleeve and at least one of the outer housing or the inner mandrel in response to the shifting of the sleeve; and retaining the sleeve is the shifted position when the retaining member engages both the sleeve and the at least one of the outer housing or the inner mandrel. In a forty seventh embodiment, actuating the release device from the locked position to the unlocked position in the forty third embodiment comprises shifting a retaining ring in response to the fluid pressure, radially expanding a locking ring in response to shifting the retaining ring, and disengaging the locking ring from the inner mandrel when radially expanded. In a forty eighth embodiment, shifting the retaining ring in the forty seventh embodiment comprises actuating an actuable device in response to the fluid pressure exceeding a threshold. In a forty ninth embodiment, actuating the release device from the locked position to the unlocked position in the forty third embodiment comprises axially shifting a plurality of lugs in response to providing the fluid pressure, radially expanding the plurality of lugs after axially shifting the plurality of lugs, and disengaging the plurality of lugs from the inner mandrel in response to the radial expansion. In a fiftieth embodiment, actuating the release device from the locked position to the unlocked position in the forty third embodiment comprises shifting a locking sleeve out of radial alignment with a locking ring in response to providing the fluid pressure, radially expanding the locking ring, and disengaging the locking ring from the inner mandrel when the locking ring is radially expanded. The locking ring may be engaged with the outer housing and the inner mandrel;

In some embodiments, the one or more release devices may be actuated using pressure supplied from the annulus between a wellbore tubular and a wellbore.

In a fifty first embodiment, a travel joint comprises an outer housing, an inner mandrel slidingly disposed within the outer housing, and a release device positioned between the outer housing and the inner mandrel. The release device comprises a locking ring engaged with the outer housing and the inner mandrel, and a locking sleeve configured to radially align with the locking ring in a locked position and axially translate out of radial alignment with the locking ring in the unlocked position. The release device is configured to selectively prevent and allow relative axial movement between the outer housing and the inner mandrel in response to a fluid pressure supplied to the release device from an exterior of the outer housing. In a fifty second embodiment, the sleeve of the fifty first embodiment may be configured to axially translate in response to the fluid pressure from the exterior of the outer housing. In a fifty third embodiment, the locking ring of the fifty first or fifty second embodiment may be configured to prevent relative axial movement between the outer housing and the inner mandrel in the locked position and allow relative axial movement between the outer housing and the inner mandrel in the unlocked position. In a fifty fourth embodiment, the travel joint of any of the fifty first to fifty third embodiments may also include a chamber formed between the locking sleeve and the outer housing, and a port configured to provide fluid communication between the exterior of the outer housing and the chamber. In a fifty fifth embodiment, the travel joint of the fifty fourth embodiment may also include a second chamber formed between the locking sleeve and the outer housing. The second chamber may be substantially sealed to fluid communication, and the second chamber may be configured to provide a pressure balance with the first chamber in the locked position. In a fifty sixth embodiment, the travel joint of the fifty fifth embodiment may also include an actuable device disposed in the port, and the actuable device may be configured to block flow through the port in the locked position and allow fluid communication through the port in the unlocked position. In a fifty seventh embodiment, the actuable device of the fifty sixth embodiment may be configured to actuate to provide fluid communication through the port in response to a pressure incident on the actuable device above a threshold. In a fifty eighth embodiment, the piston of the fifty sixth or fifty seventh embodiment may form a fluid lock when the actuable device is configured to block flow through the port.

In a fifty ninth embodiment, a travel joint comprises an outer housing, an inner mandrel slidingly disposed within the outer housing, and a release device positioned between the outer housing and the inner mandrel. The release device is in fluid communication with an exterior of the outer housing, and the release device is configured to selectively prevent and allow relative axial movement between the outer housing and the inner mandrel in response to a fluid pressure supplied from an exterior of the outer housing. In a sixtieth embodiment, the release device of the fifty ninth embodiment may comprise a locking sleeve configured to axially translate in response to the fluid pressure from the exterior of the outer housing, and the release device may be configured to transition from a locked position to an unlocked position in response to the axial translation of the locking sleeve. In a sixty first embodiment, the travel joint of the sixtieth embodiment may also include a locking member, and the locking sleeve may be configured to radially align with the locking member in the locked position and axially translate out of radial alignment with the locking ring in the unlocked position. In a sixty second embodiment, the locking member of the sixth first embodiment may be configured to engage the outer housing and the inner mandrel in the locked position. In a sixty third embodiment, the locking member of the sixth first or sixty second embodiment may be configured to prevent relative axial movement between the outer housing and the inner mandrel in the locked position and allow relative axial movement between the outer housing and the inner mandrel in the unlocked position. In a sixth fourth embodiment, the locking member of any of the sixty first to sixty third embodiments may comprise at least one of a locking ring, a plurality of lugs, or a collet indicator.

In a sixty fifth embodiment, a method of releasing a travel joint comprises preventing relative axial movement between an outer housing and an inner mandrel in a travel joint, providing a fluid pressure from an exterior of the outer housing to a release device in a locked position, actuating the release device from the locked position to an unlocked position based on the fluid pressure, and allowing relative movement between the outer housing and the inner mandrel when the release device is in the unlocked position. The release device may be disposed between the outer housing and the inner mandrel in a travel joint. In a sixty sixth embodiment, actuating the release device from the locked position to the unlocked position in the sixty fifth embodiment may comprise shifting a locking sleeve out of radial alignment with a locking ring in response to providing the fluid pressure, radially expanding the locking ring, and disengaging the locking ring from the inner mandrel when the locking ring is radially expanded. The locking ring may be engaged with the outer housing and the inner mandrel. In a sixty seventh embodiment, preventing relative axial movement between an outer housing and an inner mandrel in a travel joint in the sixty sixth embodiment may comprise providing a chamber having a fluid seal formed between the locking sleeve and the outer housing, and maintaining the locking sleeve in radial alignment with the locking ring based on the fluid seal in the chamber. The fluid seal prevent fluid communication into or out of the chamber. In a sixty eighth embodiment, providing a fluid pressure to the release device of any of the sixty fifth to sixty seventh embodiments may comprise providing a fluid pressure to an exterior of the outer housing, actuating an actuable device, providing fluid communication with a chamber formed between the locking sleeve and the outer housing in response to actuating the actuable device, and providing fluid pressure into the chamber. In a sixty ninth embodiment, the method of any of the sixty fifth to sixty eighth embodiments may also include telescoping the inner mandrel within the outer housing, and landing a tool associated with the travel joint in a wellbore in response to the telescoping. In a seventieth embodiment, the method of any of the sixty fifth to sixty ninth embodiments may also include applying an axial force to the outer housing relative to the inner mandrel, actuating an actuable device in response to the axial force above a threshold force, generating hydraulic pressure within the travel joint that is greater than a threshold pressure value, and actuating a second release device from the locked position to an unlocked position based on the hydraulic pressure generated within the travel joint.

In some embodiments, a plurality of release devices may be used to selectively release a travel joint within a wellbore.

In a seventy first embodiment, a travel joint comprises an outer housing, an inner mandrel slidingly disposed within the outer housing, a first release device positioned between the outer housing and the inner mandrel, and a second release device positioned between the outer housing and the inner mandrel. The first release device is configured to prevent relative axial movement between the outer housing and the inner mandrel in a locked position and allow relative axial movement between the outer housing and the inner mandrel in an unlocked position. The first release device is configured to actuate from the locked position to the unlocked position in response to a fluid pressure supplied to the first release device. The second release device is configured to selectively prevent and allow relative axial movement between the outer housing and the inner mandrel in response to an axial force applied to at least one of the outer housing or the inner mandrel, and the first release device is configured to prevent the application of the axial force to actuate the second release device in the locked position and allow the axial force to actuate the second release device in the unlocked position. In a seventy second embodiment, the first release device of the seventy first embodiment may be configured to actuate from the locked position to the unlocked position in response to a fluid pressure supplied through at least one of a flowbore of the outer housing, a flowbore of the inner mandrel, a control line, or an exterior of the outer housing. In a seventy third embodiment, the first release device of the seventy first or seventy second embodiment may comprise a plurality of lugs, and a sleeve configured to radially align with the plurality of lugs in the locked position and axially translate out of radial alignment with the plurality of lugs in the unlocked position. The plurality of lugs may be configured to prevent relative axial movement between the outer housing and the inner mandrel in the locked position and allow relative axial movement between the outer housing and the inner mandrel in the unlocked position, and the sleeve may be configured to axially translate in response to the fluid pressure. In a seventy fourth embodiment, the travel joint of the seventy third embodiment may also include a retaining device configured to retain the sleeve in the unlocked position when the sleeve is axially translated out of radial alignment with the plurality of lugs. In a seventy fifth embodiment, the plurality of lugs of the seventy third embodiment may be retained within lug windows in a cage sleeve. The cage sleeve may be coupled to the outer housing, and the plurality of lugs may be configured to engage a circumferential recess on an outer surface of the inner mandrel. In a seventy sixth embodiment, the first release device of the seventy first embodiment may comprise an outwardly biased locking ring. The locking ring may be configured to radially compress and engage the inner mandrel in the locked position and radially expand and disengage from the inner mandrel in the unlocked position. In a seventy seventh embodiment, the first release device of the seventy sixth embodiment may also include a retaining sleeve disposed about the locking ring. The retaining sleeve may be configured to retain the locking ring in engagement with the inner mandrel in the locked position and axially translate to allow the locking ring to radially expand in the unlocked position. In a seventy eighth embodiment, the first release device of the seventy first embodiment may comprise a plurality of lugs, and a retaining sleeve configured to maintain the plurality of lugs in engagement with the outer housing and the inner mandrel in the locked position and axially translate the plurality of lugs out of engagement with the inner mandrel in the unlocked position. The plurality of lugs may be configured to engage the outer housing and the inner mandrel to prevent relative axial movement between the outer housing and the inner mandrel in the locked position and allow relative axial movement between the outer housing and the inner mandrel in the unlocked position. In a seventy ninth embodiment, the retaining sleeve of the seventy eighth embodiment may be coupled to a piston, and the piston may be configured to translate the retaining sleeve from the locked position to the unlocked position in response to the fluid pressure. In an eightieth embodiment, the first release device of the seventy first embodiment may comprise a locking ring engaged with the outer housing and the inner mandrel, and a locking sleeve configured to radially align with the locking ring in the locked position and axially translate out of radial alignment with the locking ring in the unlocked position. The sleeve may be configured to axially translate in response to the fluid pressure from the exterior of the outer housing. In an eighty first embodiment, the travel joint of the eightieth embodiment may also include a chamber formed between the locking sleeve and the outer housing, and a port configured to provide fluid communication between the exterior of the outer housing and the chamber. In an eighty second embodiment, the travel joint of the eighty first embodiment may also include an actuable device disposed in the port, and the actuable device may be configured to block flow through the port in the locked position and allow fluid communication through the port in the unlocked position. In a eighty third embodiment, the second release device of the seventy first embodiment may comprise a hydraulically metered release device, wherein the hydraulically metered release device may be configured to selectively prevent and allow relative axial movement between the outer housing and the inner mandrel in response to an mechanical force applied to the outer housing in an axial direction.

In an eighty fourth embodiment, a travel joint comprises an outer housing, an inner mandrel slidingly disposed within the outer housing, and a plurality of release devices. At least two of the plurality of release devices are configured to actuate in response to different forces, and the different forces comprise at least a mechanical force and a pressure force. The plurality of release devices are configured to be sequentially actuated from a locked position to an unlocked position. In an eighty fifth embodiment, the pressure force of the eighty fourth embodiment may comprise a fluid pressure supplied through at least one of a flowbore of the outer housing, a flowbore of the inner mandrel, a control line, or an exterior of the outer housing. In an eighty sixth embodiment, the mechanical force of the eighty fourth embodiment may comprise at least one of an axial downward force, an axial upwards force, or a rotational force.

In an eighty seventh embodiment, a method of releasing a travel joint comprises preventing relative axial movement between an outer housing and an inner mandrel in a travel joint, providing a fluid pressure to a first release device in a locked position, actuating the first release device from the locked position to an unlocked position based on the fluid pressure, providing a mechanical force to a second release device in a locked position, actuating the second release device from the locked position to an unlocked position based on the mechanical force, and allowing relative movement between the outer housing and the inner mandrel when the first release device is in the unlocked position and when the second release device is in the unlocked position. The first release device is disposed between the outer housing and the inner mandrel in a travel joint. In an eighty eighth embodiment, the method of the eighty seventh embodiment may also include preventing, by the first release device, the mechanical force from being provided to the second release device while the first release device is in the locked position. In an eighty ninth embodiment, providing the fluid pressure to the first release device in the eighty seventh embodiment may comprise at least one of providing the fluid pressure through a flowbore of the inner mandrel, providing the fluid pressure through a flowbore of the outer housing, providing the fluid pressure through a control line, providing the fluid pressure from a surface of the wellbore, or providing the fluid pressure from an exterior of the outer housing. In a ninetieth embodiment, the method of any of the eighty seventh to eighty ninth embodiments may also include telescoping the inner mandrel within the outer housing when relative movement is allowed, and landing a tool associated with the travel joint in a wellbore in response to the telescoping.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed:

1. A travel joint comprising:

an outer housing;

an inner mandrel slidingly disposed within the outer housing;

a first release device positioned between the outer housing and the inner mandrel, wherein the first release device is configured to prevent relative axial movement between the outer housing and the inner mandrel in a locked position and allow relative axial movement between the outer housing and the inner mandrel in an unlocked position, and wherein the first release device is configured to actuate from the locked position to the unlocked position in response to a fluid pressure supplied to the first release device;

a second release device positioned between the outer housing and the inner mandrel, wherein the second release device is configured to selectively prevent and allow relative axial movement between the outer housing and the inner mandrel in response to an axial force applied to at least one of the outer housing or the inner mandrel, wherein the first release device is configured to prevent the application of the axial force to actuate the second release device in the locked position and allow the axial force to actuate the second release device in the unlocked position; and wherein the first release device comprises an outwardly biased locking ring, wherein the outwardly biased locking ring is configured to radially compress and engage the inner mandrel in the locked position and radially expand and disengage from the inner mandrel in the unlocked position.

2. The travel joint of claim 1, wherein the first release device is configured to actuate from the locked position to the unlocked position in response to the fluid pressure supplied through at least one of a flowbore of the outer housing, a flowbore of the inner mandrel, a control line, or an exterior of the outer housing.

3. The travel joint of claim 1, wherein the first release device further comprises a retaining sleeve disposed about the outwardly biased locking ring, wherein the retaining sleeve is configured to retain the outwardly biased locking ring in engagement with the inner mandrel in the locked position and axially translate to allow the outwardly biased locking ring to radially expand in the unlocked position.

4. The travel joint of claim 1, wherein the first release device comprises:

a retaining sleeve configured to radially align with the outwardly biased locking ring in the locked position and axially translate out of radial alignment with the outwardly biased locking ring in the unlocked position, wherein the retaining sleeve is configured to axially translate in response to the fluid pressure supplied to an upper side of the retaining sleeve through a flow path between the inner mandrel and the outer housing.

5. The travel joint of claim 4, further comprising a chamber formed between the retaining sleeve and the outer housing; and a port configured to provide fluid communication between the exterior of the outer housing and the chamber.

6. The travel joint of claim 5, further comprising an actuable device disposed in the port, wherein the actuable device is configured to block flow through the port in the locked position and allow fluid communication through the port in the unlocked position.

7. The travel joint of claim 1, wherein the second release device comprises a hydraulically metered release device, wherein the hydraulically metered release device is configured to selectively prevent and allow relative axial movement between the outer housing and the inner mandrel in response to a mechanical force applied to the outer housing in an axial direction.

8. A travel joint comprising:

an outer housing;

an inner mandrel slidingly disposed within the outer housing;

a first release device positioned between the outer housing and the inner mandrel, wherein the first release device is configured to prevent relative axial movement between the outer housing and the inner mandrel in a locked position and allow relative axial movement between the outer housing and the inner mandrel in an unlocked position, wherein the first release device is configured to actuate from the locked position to the unlocked position in response to a fluid pressure supplied to the first release device;

a second release device positioned between the outer housing and the inner mandrel, wherein the second release device is configured to selectively prevent and allow relative axial movement between the outer housing and the inner mandrel in response to an axial force applied to at least one of the outer housing or the inner mandrel, wherein the first release device is configured to prevent the application of the axial force to actuate the second release device in the locked position and allow the axial force to actuate the second release device in the unlocked position;

wherein the first release device comprises:

a plurality of lugs, wherein the plurality of lugs is configured to prevent relative axial movement between the outer housing and the inner mandrel in the locked position and allow relative axial movement between the outer housing and the inner mandrel in the unlocked position; and a sleeve configured to radially align with the plurality of lugs in the locked position and axially translate out of radial alignment with the plurality of lugs in the unlocked position, wherein the sleeve is configured to axially translate in response to the fluid pressure.

9. The travel joint of claim 8, further comprising a retaining device configured to retain the sleeve in the unlocked position when the sleeve is axially translated out of radial alignment with the plurality of lugs.

10. The travel joint of claim 8, wherein the plurality of lugs is retained within lug windows in a cage sleeve, wherein the cage sleeve is coupled to the outer housing, and wherein the plurality of lugs is configured to engage a circumferential recess on an outer surface of the inner mandrel.

11. The travel joint of claim 8, wherein the plurality of lugs is configured to engage the outer housing and the inner mandrel, and wherein the sleeve is a retaining sleeve configured to maintain the plurality of lugs in engagement with the outer housing and the inner mandrel in the locked position and axially translate the plurality of lugs out of engagement with the inner mandrel in the unlocked position.

12. The travel joint of claim 11, wherein the retaining sleeve is coupled to a piston, and wherein the piston is configured to translate the retaining sleeve from the locked position to the unlocked position in response to the fluid pressure.

13. The travel joint of claim 8, wherein the second release device comprises a hydraulically metered release device, wherein the hydraulically metered release device is configured to selectively prevent and allow relative axial movement between the outer housing and the inner mandrel in response to a mechanical force applied to the outer housing in an axial direction.

14. A travel joint comprising:

an outer housing;

an inner mandrel slidingly disposed within the outer housing;

a plurality of release devices, wherein at least two of the plurality of release devices are configured to actuate in response to different forces, wherein the different forces comprise at least a mechanical force and a pressure force, and wherein the plurality of release devices are configured to be sequentially actuated from a locked position to an unlocked position; and wherein a first release device of the at least two of the plurality of release devices comprises an outwardly biased locking ring, wherein the outwardly biased locking ring is configured to radially compress and engage the inner mandrel in the locked position and radially expand and disengage from the inner mandrel in the unlocked position, wherein the first release device is configured to actuate from the locked position to the unlocked position in response to the pressure force supplied to the first release device, and wherein the first release device is configured to prevent application of the mechanical force in the locked position and allow application of the mechanical force in the unlocked position.

15. The travel joint of claim 14, wherein the pressure force comprises a fluid pressure supplied through at least one of a flowbore of the outer housing, a flowbore of the inner mandrel, a control line, or an exterior of the outer housing.

16. The travel joint of claim 14, wherein the mechanical force comprises at least one of an axial downward force, an axial upwards force, or a rotational force.

17. A method of releasing a travel joint comprising:

preventing relative axial movement between an outer housing and an inner mandrel in the travel joint;

providing a fluid pressure to a first release device in a locked position, wherein the first release device is disposed between the outer housing and the inner mandrel in the travel joint;

actuating the first release device from the locked position to an unlocked position based on the fluid pressure;

providing a mechanical force to a second release device in a locked position;

actuating the second release device from the locked position to an unlocked position based on the mechanical force;

allowing relative movement between the outer housing and the inner mandrel when the first release device is in the unlocked position and when the second release device is in the unlocked position by radially expanding an outwardly biased locking ring of the first release device to disengage the outwardly biased locking ring from the inner mandrel; and disallowing relative movement between the outer housing and the inner mandrel when the first release device is in the locked position by radially compressing the outwardly biased locking ring of the first release device to engage the outwardly biased locking ring with the inner mandrel.

18. The method of claim 17, further comprising: preventing, by the first release device, the mechanical force from being provided to the second release device while the first release device is in the locked position.

19. The method of claim 17, wherein providing the fluid pressure to the first release device comprises at least one of providing the fluid pressure through a flowbore of the inner mandrel, providing the fluid pressure through a flowbore of the outer housing, providing the fluid pressure through a control line, providing the fluid pressure from a surface of a wellbore, or providing the fluid pressure from an exterior of the outer housing.

20. The method of claim 17, further comprising:

telescoping the inner mandrel within the outer housing when relative movement is allowed; and landing a tool associated with the travel joint in a wellbore in response to the telescoping.

21. A method of releasing a travel joint comprising:

preventing relative axial movement between an outer housing and an inner mandrel in the travel joint;

providing a fluid pressure to a first release device in a locked position, wherein the first release device is disposed between the outer housing and the inner mandrel in the travel joint;

actuating the first release device from the locked position to an unlocked position based on the fluid pressure, wherein the first release device comprises a plurality of lugs and a sleeve, wherein the plurality of lugs is configured to prevent relative axial movement between the outer housing and the inner mandrel in the locked position and allow relative axial movement between the outer housing the inner mandrel in the unlocked position, and wherein the sleeve is configured to radially align with the plurality of lugs in the locked position and axially translate out of radial alignment with the plurality of lugs in the unlocked position, wherein the sleeve is configured to axially translate in response to the fluid pressure;

providing a mechanical force to a second release device in a locked position; and actuating the second release device from the locked position to an unlocked position based on the mechanical force;

allowing relative movement between the outer housing and the inner mandrel when the first release device is in the unlocked position and when the second release device is in the unlocked position.

* * * * *